US011673284B2

(12) United States Patent
Mizutani

(10) Patent No.: US 11,673,284 B2
(45) Date of Patent: Jun. 13, 2023

(54) CUTTING DEVICE CAPABLE OF APPROPRIATELY PERFORMING CUTTING OPERATIONS EVEN WHEN ONE OF FIRST AND SECOND DETECTING PORTIONS DOES NOT NORMALLY OPERATE

(71) Applicant: BROTHER KOGYO KABUSHIKI KAISHA, Nagoya (JP)

(72) Inventor: Hiromitsu Mizutani, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 390 days.

(21) Appl. No.: 16/926,443

(22) Filed: Jul. 10, 2020

(65) Prior Publication Data

US 2021/0016462 A1 Jan. 21, 2021

(30) Foreign Application Priority Data

Jul. 16, 2019 (JP) ..... JP2019-130835

(51) Int. Cl.

| | |
|---|---|
| ***B26D 1/30*** | (2006.01) |
| ***B41J 11/70*** | (2006.01) |
| ***B65H 35/04*** | (2006.01) |
| ***B41J 11/66*** | (2006.01) |
| *B26D 7/00* | (2006.01) |

(52) U.S. Cl.

CPC ..... *B26D 1/305* (2013.01); *B41J 11/663* (2013.01); *B41J 11/703* (2013.01); *B41J 11/706* (2013.01); *B65H 35/04* (2013.01); *B26D 2007/005* (2013.01)

(58) Field of Classification Search

CPC ..... B41J 11/663; B41J 11/703; B41J 11/706; B26D 1/305; B26D 2007/005; B65H 35/04

See application file for complete search history.

(56) References Cited

U.S. PATENT DOCUMENTS

2014/0307019 A1* 10/2014 Muro ..... B41J 11/46 347/16

2015/0084262 A1 3/2015 Sago et al.

FOREIGN PATENT DOCUMENTS

JP 2015-085507 A 5/2015

* cited by examiner

*Primary Examiner* — Evan H MacFarlane
*Assistant Examiner* — Liang Dong
(74) *Attorney, Agent, or Firm* — Kenealy Vaidya LLP

(57) ABSTRACT

A cutting device includes: a movable blade; a moving mechanism moving the movable blade and having a first mechanism portion movable between a first operating position and a first non-operating position and a second mechanism portion movable between a second operating position and a second non-operating position; a first detecting portion and a second detecting portion detecting positions of the first mechanism portion and the second mechanism portion; and a controller configured to perform: setting, when one of the first detecting portion and the second detecting portion detects abnormally, updated positions of the first operating position and the second operating position or the first non-operating position and the second non-operating position. The updated positions are set based on detection result of another of the first detecting portion and the second detecting portion and are new start points of movement of the first mechanism portion and the second mechanism portion.

11 Claims, 23 Drawing Sheets

FIG. 9

| DETECTION SENSOR | FULL-CUTTING | | STANDBY STATE | HALF-CUTTING | |
|---|---|---|---|---|---|
| | SECOND CUTTING POSITION | SECOND STANDBY POSITION ~ SECOND CUTTING POSITION | FIRST STANDBY POSITION | FIRST STANDBY POSITION ~ FIRST CUTTING POSITION | FIRST CUTTING POSITION |
| FIRST SENSOR | ON | OFF | OFF | OFF | ON |
| SECOND SENSOR | ON | ON | OFF | OFF | OFF |

REVERSE ROTATION ← ROTATIONAL DIRECTION OF CUTTER MOTOR → FORWARD ROTATION

CUTTING DEVICE CAPABLE OF APPROPRIATELY PERFORMING CUTTING OPERATIONS EVEN WHEN ONE OF FIRST AND SECOND DETECTING PORTIONS DOES NOT NORMALLY OPERATE

CROSS REFERENCE TO RELATED APPLICATION

This application claims priority from Japanese Patent Application No. 2019-130835 filed Jul. 16, 2019. The entire content of the priority application is incorporated herein by reference.

TECHNICAL FIELD

The present disclosure relates to a cutting device and a printing device.

BACKGROUND

Japanese Patent Application Publication No. 2015-85507 describes a tape printing device provided with a cutting mechanism for cutting a tape on which printing has been performed. The cutting mechanism includes a half-cutting mechanism, a full-cutting mechanism, and a cutter motor. Each of the half-cutting mechanism and the full-cutting mechanism includes a movable portion coupled to a cam plate that is rotatable in association with the cutter motor. One of the two movable portions is pivotally moved as the cam plate is rotated.

Specifically, only the movable portion of the half-cutting mechanism operates when the cam plate is rotated in a first actuating direction from a reference angular position. Conversely, only the movable portion of the full-cutting mechanism operates when the cam plate is rotated in a second actuating direction from the reference angular position. Two sensors are provided for detecting the angular position of the cam plate. A pivot position of each movable portion can be recognized based on detection results from the two sensors.

SUMMARY

However, in some cases one of the two sensors in the tape printing device is unable to operate normally due to, for example, the sensor being displaced from its prescribed position. In such cases, the cutting mechanism cannot operate properly.

In view of the foregoing, it is an object of the present disclosure to provide a cutting device and a printing device capable of executing normal operations based on the detection results from only one of two detection portions even when the remaining one of the two detection portions is unable to operate normally.

In order to attain the above and other objects, according to one aspect, the disclosure provides a cutting device including: a movable blade; a moving mechanism; a driver; a first detecting portion; a second detecting portion; a storage medium; and a controller. The movable blade is configured to cut at least a portion of an object. The moving mechanism is configured to move the movable blade. The moving mechanism includes: a first mechanism portion; and a second mechanism portion. The first mechanism portion is reciprocally movable between a first operating position and a first non-operating position. The second mechanism portion is reciprocally movable between a second operating position and a second non-operating position. The driver is configured to be driven to move the moving mechanism. The first detecting portion is for performing detection of the first operating position of the first mechanism portion and the second operating position of the second mechanism portion. The second detecting portion is for performing detection of the first non-operating position of the first mechanism portion and the second non-operating position of the second mechanism portion. The controller is configured to perform: (a) setting, when one of the first detecting portion and the second detecting portion does not perform detection accurately, an updated position of each of one of the first operating position and the second operating position and the first non-operating position and the second non-operating position, the updated position being set based on detection result of the remaining one of the first detecting portion and the second detecting portion that performs detection accurately and being a new start point of reciprocating movement of the first mechanism portion and the second mechanism portion in place of the one of the first operating position and the second operating position and the first non-operating position and the second non-operating position; and (b) storing the updated position set in the (a) setting in the storage medium.

According to another aspect, the disclosure provides a printing device including: a cutting device; and a printing mechanism. The cutting device includes: a movable blade; a moving mechanism; a driver; a first detecting portion for performing detection of the first operating position of the first mechanism portion and the second operating position of the second mechanism portion; a second detecting portion for performing detection of the first non-operating position of the first mechanism portion and the second non-operating position of the second mechanism portion; a storage medium; and a controller. The movable blade is configured to cut at least a portion of an object. The moving mechanism is configured to move the movable blade. The moving mechanism includes: a first mechanism portion; and a second mechanism portion. The first mechanism portion is reciprocally movable between a first operating position and a first non-operating position. The second mechanism portion is reciprocally movable between a second operating position and a second non-operating position. The driver is configured to be driven to move the moving mechanism. The controller is configured to perform: (a) setting, when one of the first detecting portion and the second detecting portion does not perform detection accurately, an updated position of each of one of the first operating position and the second operating position and the first non-operating position and the second non-operating position, the updated position being set based on detection result of the remaining one of the first detecting portion and the second detecting portion that performs detection accurately and being a new start point of reciprocating movement of the first mechanism portion and the second mechanism portion in place of the one of the first operating position and the second operating position and the first non-operating position and the second non-operating position; and (b) storing the updated position set in the (a) setting in the storage medium. The printing mechanism configured to perform printing on the object.

BRIEF DESCRIPTION OF THE DRAWINGS

The particular features and advantages of the embodiment(s) as well as other objects will become apparent from the following description taken in connection with the accompanying drawings, in which:

FIG. 9 is a table illustrating a relationship between a state of the cutting mechanism 80 and an output signal outputted from a first sensor 91 and a second sensor 92 in the printing device 1 according to the embodiment;

DETAILED DESCRIPTION

Figure 1:
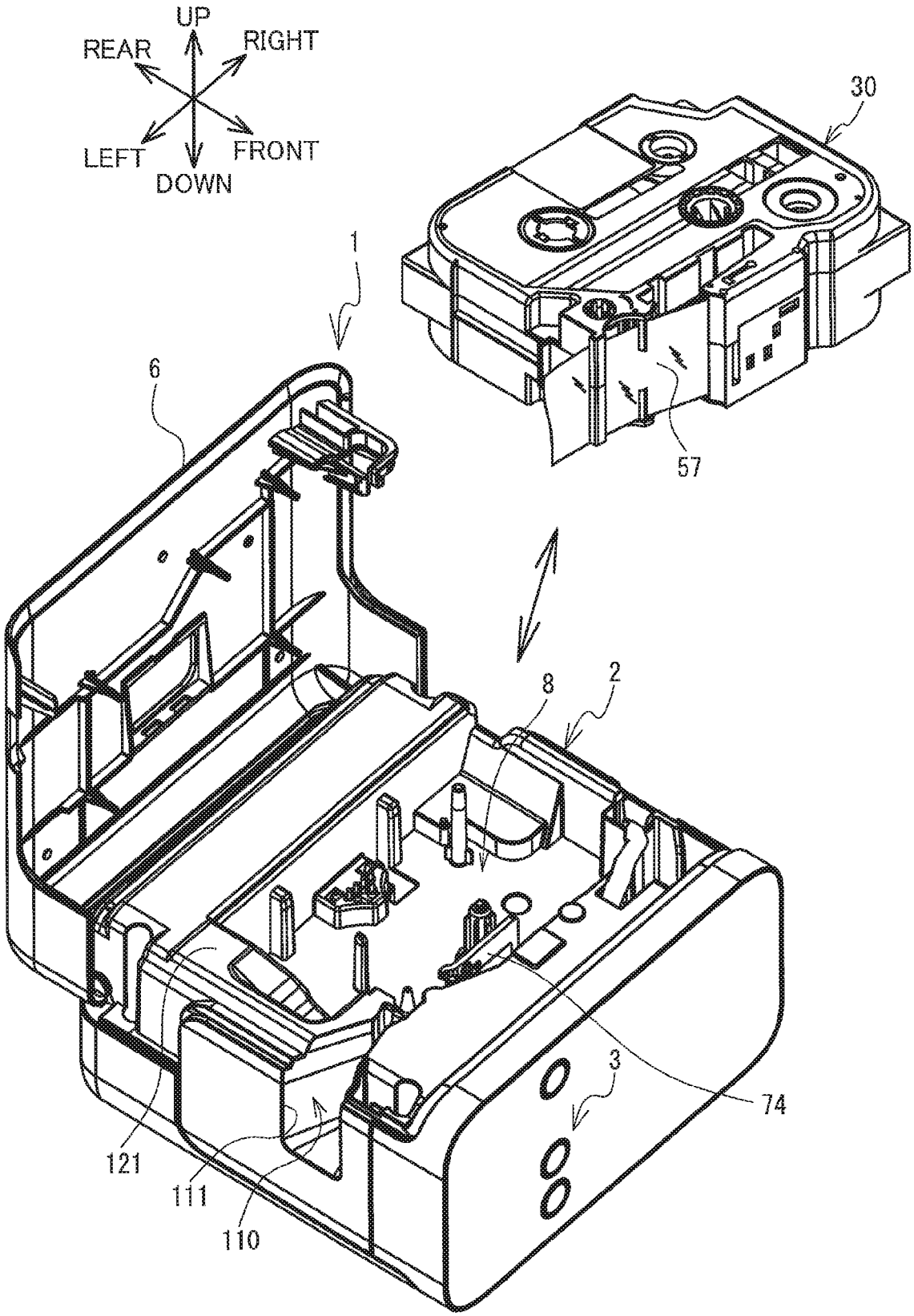
FIG. 1 is a perspective view of a printing device 1 according to one embodiment of the present disclosure and a tape cassette 30 attachable to the printing device 1.

Hereinafter, one embodiment of the present disclosure will be described while referring to the accompanying drawings. The referenced drawings are used to describe the technical features made possible with the present disclosure. The configurations and control of a device illustrated in the drawings are merely examples, and the present disclosure is not intended to be limited to these configurations and control.

<Mechanical Configuration of Printing Device 1>

The mechanical configuration of a printing device 1 according to the embodiment will be described with reference to FIGS. 1 through 8. A tape cassette 30 that accommodates a tape 57 therein is replaceably attached to the printing device 1, and the printing device 1 performs printing on the tape 57. The printing device 1 has a configuration substantially identical to a mechanical configuration of a tape printing device described in Japanese Patent Application Publication No. 2015-85507 filed by the applicant of the present disclosure.

In the following description, the lower-left side, the upper-right side, the lower-right side, the upper-left side, the upper side, and the lower side in FIG. 1 will be defined as the left side, the right side, the front side, the rear side, the upper side, and the lower side of the printing device 1 and the tape cassette 30, respectively.

As illustrated in FIG. 1, the printing device 1 includes a housing 2 having a substantially rectangular parallelepiped shape. A cassette attachment portion 8 to which the tape cassette 30 is detachably attached is provided in the housing 2. Switches 3 are provided on a front surface of the housing 2 for operating the printing device 1.

A cassette cover 6 is provided at a position above the housing 2. The cassette cover 6 is opened and closed when replacing the tape cassette 30. The cassette cover 6 is a lid having a substantially rectangular shape in a plan view. The cassette cover 6 is supported by shafts provided at a rear portion of the housing 2 at respective left and right end portions. FIG. 1 illustrates a state where the cassette cover 6 is opened. An LED 4 (see FIG. 10) is provided on the cassette cover 6. The LED 4 can be lit or flashed.

A discharge opening 111 is an opening formed on a left surface of the housing 2. The discharge opening 111 and the cassette attachment portion 8 are in communication with each other through a tape discharge portion 110 that forms a conveying path of the printed tape 57. After being printed, the tape 57 in the cassette attachment portion 8 passes through the tape discharge portion 110 and is discharged out of the housing 2 through the discharge opening 111. A cutting mechanism 80 (see FIG. 2) for cutting the printed tape 57 is disposed in the tape discharge portion 110 between the discharge opening 111 and the cassette attachment portion 8. The cutting mechanism 80 will be described later in detail.

As illustrated in FIG. 1, a head holder 74 is disposed upright in a front portion of the cassette attachment portion 8. A thermal head 10 (see FIG. 10) is provided on a front surface of the head holder 74. A platen roller (not illustrated) is rotatably supported at a position frontward of the thermal head 10. The platen roller is capable of contacting and separating from the thermal head 10. A tape drive motor 26 (see FIG. 10) is disposed at a lower portion of the cassette attachment portion 8. The tape drive motor 26 is a stepping motor.

Although not illustrated in the drawings in detail, the tape 57 accommodated in the tape cassette 30 has a printable base, and an adhesive tape. The printable base is a translucent film tape with a long scale. One surface of the printable base serves as a printing surface on which the printing device 1 performs printing. The adhesive tape is bonded to the printing surface of the printable base. The adhesive tape has a first adhesive layer, a background base, a second adhesive layer, and a release paper. The first adhesive layer is disposed between the background base and the printable base. The second adhesive layer is disposed between the background base and the release paper. More specifically, the first adhesive layer and the second adhesive layer are formed by applying adhesive material to both surfaces of the background base. That is, the tape 57 is constituted by a plurality of layers.

<Cutting Mechanism 80>

Figure 2:
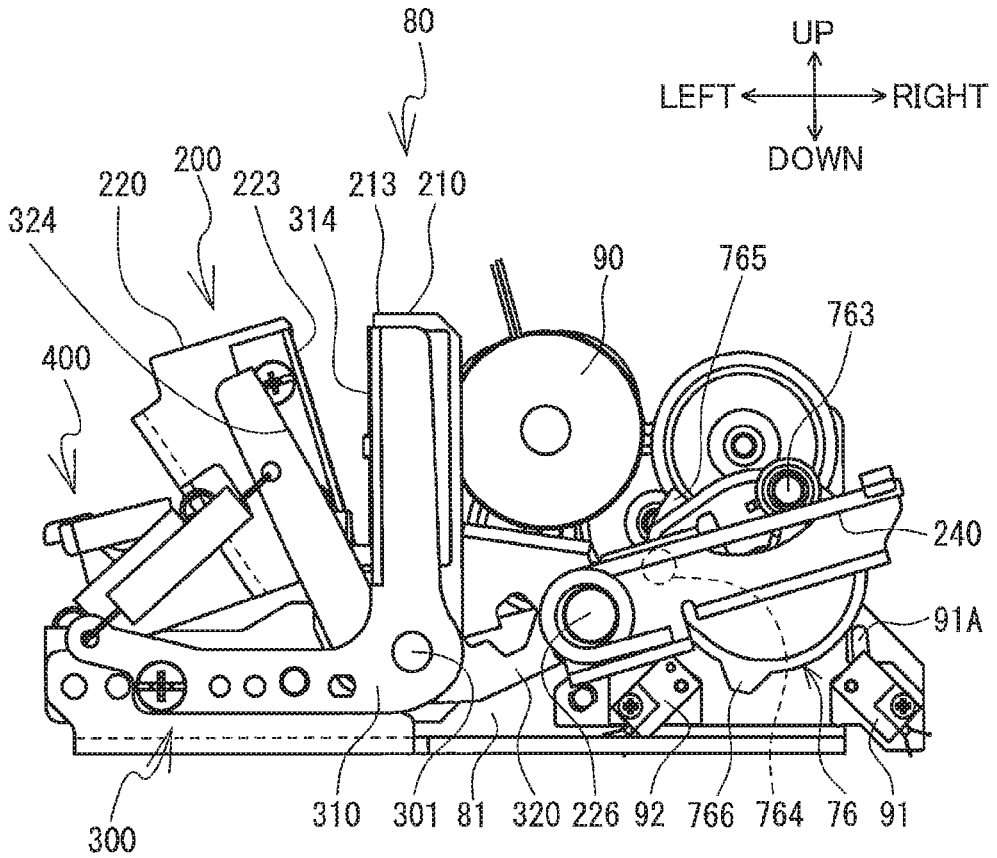
FIG. 2 is a view illustrating a cutting mechanism 80 in its standby state of the printing device 1 according to the embodiment as viewed from the right side of the printing device 1.

The cutting mechanism 80 will be described next with reference to FIGS. 2 through 8. FIG. 2 illustrates the cutting mechanism 80 when an internal cover 121 of the housing 2 in FIG. 1 has been removed as viewed from the right side. The cutting mechanism 80 has a configuration identical to a mechanical configuration of a cutting mechanism described in Japanese Patent Application Publication No. 2015-85507 filed by the applicant of the present disclosure.

For convenience of description, the left side, the right side, the near side, the far side, the upper side, and the lower side in FIG. 2 will denote the left side, the right side, the front side, the rear side, the upper side, and the lower side of the cutting mechanism 80. When the cutting mechanism 80 is accommodated within the printing device 1, the left and right sides in FIG. 2 become the front and rear sides in FIG. 1, and the front and rear sides in FIG. 2 become the right and left sides in FIG. 1.

As illustrated in FIG. 2, the cutting mechanism 80 includes a half-cutting mechanism 200, a full-cutting mechanism 300, a conveying mechanism 400 (see FIGS. 5, 7 and 8), a cutter motor 90, and a drive cam 76. Beginning from the front side, the mechanisms mentioned above are arranged in the order of the full-cutting mechanism 300, the half-cutting mechanism 200, and the conveying mechanism 400.

Figure 3:
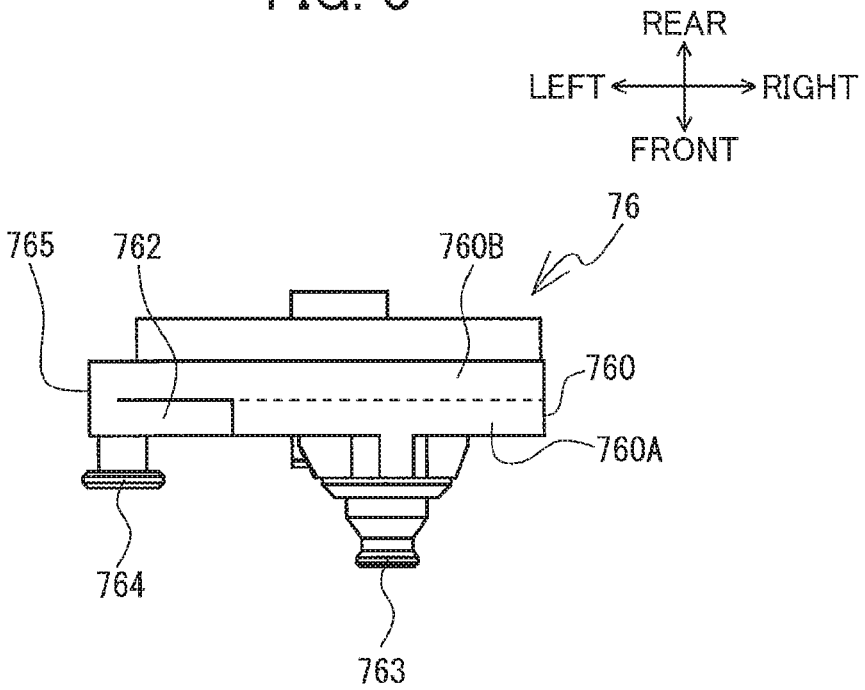
FIG. 3 is a plan view of a cam plate 760 of the cutting mechanism 80 in the printing device 1 according to the embodiment.
Figure 4:
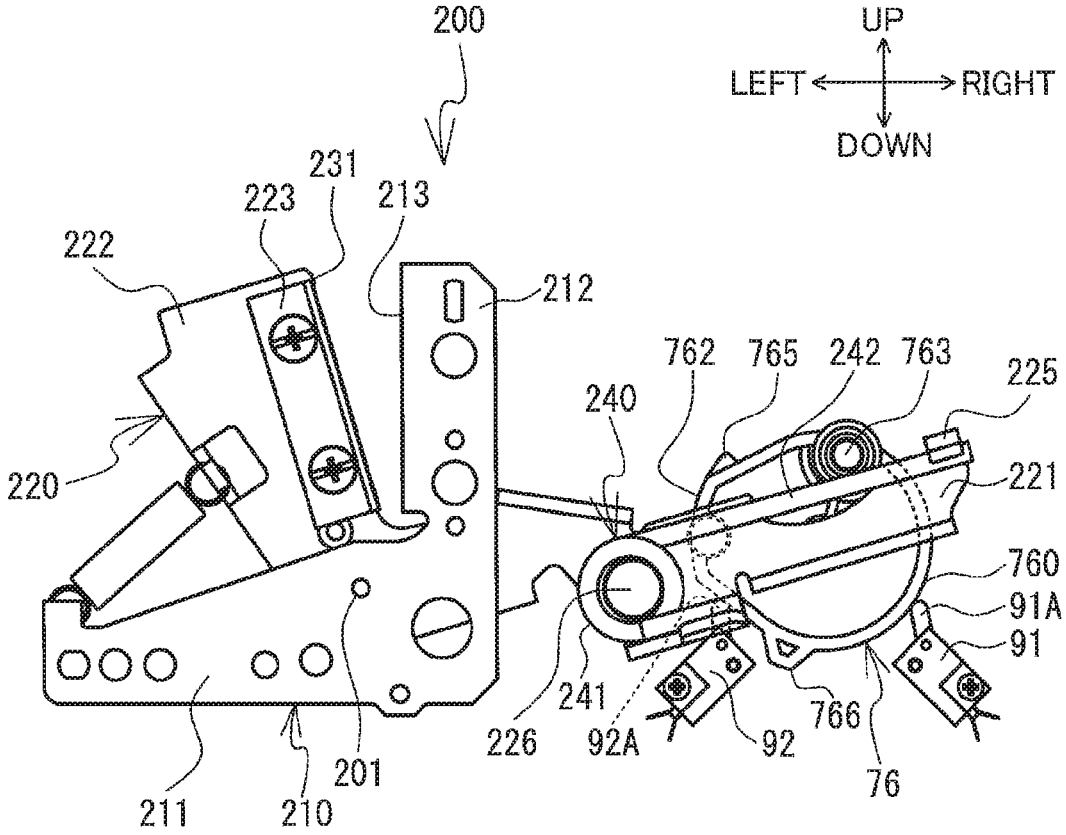
FIG. 4 is a view illustrating a half-cutting mechanism 200 of the cutting mechanism 80 in the printing device 1 according to the embodiment when the cam plate 760 is at a reference angular position.
Figure 5:
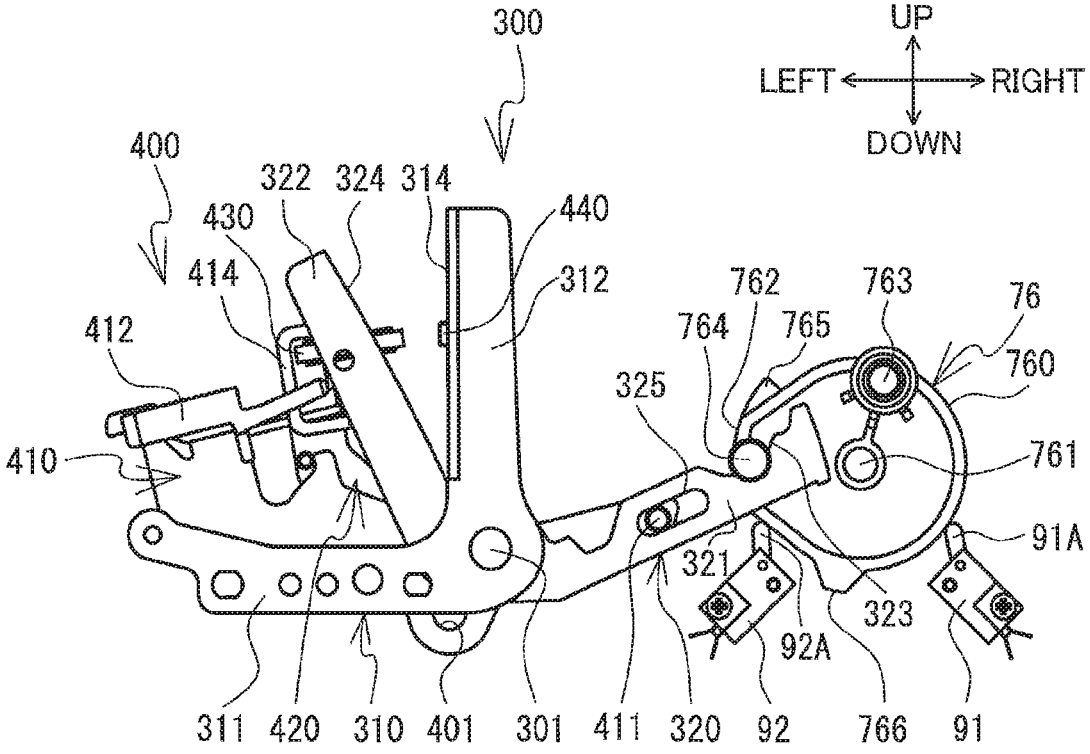
FIG. 5 is a view illustrating a full-cutting mechanism 300 and a conveying mechanism 400 of the cutting mechanism 80 in the printing device 1 according to the embodiment when the cam plate 760 is at the reference angular position.

As illustrated in FIGS. 3 through 5, the drive cam 76 includes a cam plate 760 having a substantially circular plate shape. A through-hole (not illustrated) extending in the front-rear direction is formed in the cam plate 760. A shaft portion 761 (see FIGS. 5 through 7) provided on a base plate 81 and extending frontward therefrom is inserted through the through-hole formed in the cam plate 760. With this configuration, the drive cam 76 is rotatable about the shaft portion 761. The cam plate 760 has a protruding portion 762. The protruding portion 762 is a portion of the cam plate 760 that protrudes radially outward. Other than the protruding portion 762, a circumferential surface of the cam plate 760 is approximately equidistant from the shaft portion 761 (i.e., has approximately the same radius; see FIG. 4).

The circumferential surface of the cam plate 760 includes a front circumferential surface 760A and a rear circumferential surface 760B. The front circumferential surface 760A is a circumferential surface of the cam plate 760 provided frontward of the approximate center in a front-rear direction of the same. The rear circumferential surface 760B is a circumferential surface of the cam plate 760 provided rearward of the approximate center in the front-rear direction of the same. The protruding portion 762 described above constitutes a portion of the front circumferential surface 760A.

As illustrated in FIGS. 3 through 5, a first drive pin 763, a second drive pin 764, a first detection plate 765, and a second detection plate 766. The first drive pin 763 and the second drive pin 764 both protrude frontward from the cam plate 760. Specifically, the second drive pin 764 protrudes frontward from the protruding portion 762. The first drive pin 763 protrudes frontward from an outer edge of the cam plate 760 other than the protruding portion 762. As illustrated in FIG. 5, the first drive pin 763 is disposed at a position rotated approximately 90 degrees clockwise from the second drive pin 764 about the shaft portion 761.

The first detection plate 765 is a plate member that protrudes radially outward from the rear circumferential surface 760B. The first detection plate 765 is provided rearward of the protruding portion 762. The second detection plate 766 is a plate member that protrudes radially outward from the front circumferential surface 760A. As illustrated in FIG. 5, the second detection plate 766 is provided at a position rotated approximately 90 degrees counterclockwise from the protruding portion 762 about the shaft portion 761. A protruding edge of the first detection plate 765 and a protruding edge of the second detection plate 766 are equidistant from the shaft portion 761.

The half-cutting mechanism 200 will be described next with reference to FIG. 4. The half-cutting mechanism 200 is provided for cutting through only some of the layers of the tape 57. In the present embodiment, the half-cutting mechanism 200 does not cut the release paper in the tape 57, but cuts through the printable base, the first adhesive layer, the background base, and the second adhesive layer. The half-cutting mechanism 200 includes a fixed portion 210, a movable portion 220, and a pressing spring 240.

The fixed portion 210 is a plate-shaped member having a substantially L-shape, and includes a first plate portion 211, a second plate portion 212, and a receiving member 213. The first plate portion 211 is a plate-shaped member that extends in a left-right direction. The first plate portion 211 is fixed to the base plate 81 (see FIG. 2) by screws (not illustrated). The second plate portion 212 is a plate-shaped member that extends upward from a right end portion of the first plate portion 211. The receiving member 213 is a surface portion protruding rearward (the far side in FIG. 4) from a left edge portion of the second plate portion 212 and parallel to the front-rear direction and an up-down direction. The receiving member 213 has a rectangular shape that has a long dimension in the up-down direction and a short dimension in the front-rear direction.

The movable portion 220 is a plate-shaped member having a substantially L-shape. The movable portion 220 includes a first plate portion 221, a second plate portion 222, a cutting blade 223, and a protruding portion 231. The movable portion 220 is arranged to overlap a rear surface of the fixed portion 210 and disposed frontward of the cam plate 760. The first plate portion 221 is a plate-shaped member extending in the substantially left-right direction. The first plate portion 221 extends from the rear surface side of the fixed portion 210 to the front surface side of the cam plate 760.

The second plate portion 222 is a plate-shaped member that extends upward from a left end portion of the first plate portion 221 and is sloped at approximately 90 degrees relative to the first plate portion 221. The cutting blade 223 is a blade that extends along a right edge of the second plate portion 222 and opposes the receiving member 213 from the left side. The protruding portion 231 is disposed on a right portion of an upper end portion of the second plate portion 222. The protruding portion 231 protrudes slightly closer to the receiving member 213 than the cutting blade 223 from a position above the cutting blade 223.

A support hole (not illustrated) penetrating the movable portion 220 is formed in a region at which the first plate portion 221 and the second plate portion 222 are connected. A rotational shaft 201 is provided on the fixed portion 210 in the region that the first plate portion 211 and the second plate portion 212 are connected and extends rearward therefrom. The rotational shaft 201 is inserted through the support hole formed in the movable portion 220 and rotatably supports the movable portion 220.

The pressing spring 240 is a coil spring that is retained by the first plate portion 221. The pressing spring 240 includes a coil portion 241, and an arm portion 242. A support shaft 226 provided on the first plate portion 221 and extending frontward therefrom is inserted through the coil portion 241. Accordingly, the coil portion 241 is supported by the support shaft 226. The arm portion 242 extends rightward along a direction in which the first plate portion 221 extends. An engaging plate 225 protruding frontward is provided on a right end portion of the first plate portion 221. The arm portion 242 has a distal end portion engaged with the engaging plate 225 while urging the engaging plate 225 upward from the lower side thereof.

Next, the full-cutting mechanism 300 will be described with reference to FIG. 5. The full-cutting mechanism 300 is provided for cutting through all layers of the tape 57, i.e., for cutting off a segment of the tape 57. The full-cutting mechanism 300 includes a fixed portion 310, and a movable portion 320.

The fixed portion 310 is a plate-shaped member having a substantially L-shape, and includes a first plate portion 311, a second plate portion 312, and a fixed blade 314. The first plate portion 311 is a plate member that extends in the left-right direction. The first plate portion 311 is fixed to the base plate 81 (see FIG. 2) by screws (not illustrated). The second plate portion 312 is a plate member that extends upward from a right end portion of the first plate portion 311. The fixed blade 314 is a blade extending in the up-down direction along a left edge of the second plate portion 312.

The movable portion 320 is a plate member having a substantially L-shape, and includes a first plate portion 321, a second plate portion 322, and a movable blade 324. The movable portion 320 is arranged to overlap a rear surface of the fixed portion 310, and disposed frontward of the cam plate 760. The first plate portion 321 is a plate portion that extends in the substantially left-right direction. The first plate portion 321 extends from the rear surface side of the fixed portion 310 to the front surface side of the cam plate 760. The second plate portion 322 is a plate portion that extends upward from a left end portion of the first plate portion 321 and slopes at approximately 90 degrees relative to the first plate portion 321. The movable blade 324 is a blade extending along a right edge of the second plate portion 322 and opposing the fixed blade 314 from the left side.

A rotational shaft 301 is disposed in the portion of the fixed portion 310 at which the first plate portion 311 and the second plate portion 312 are connected and extends rearward therefrom. A support hole (not illustrated) is formed in the area of the movable portion 320 that the first plate portion 321 and the second plate portion 322 are connected and penetrates the movable portion 320. The rotational shaft 301 is inserted into the support hole formed in the movable portion 320 and rotatably supports the movable portion 320.

The first plate portion 321 is formed with a guide portion 323 and a guide hole 325. The guide portion 323 is provided in a right end portion of the first plate portion 321 to be recessed downward from an upper edge of the first plate portion 321. The guide hole 325 is an elongated hole penetrating the first plate portion 321 in the approximate center in the longitudinal direction of the same. The guide hole 325 extends substantially parallel to the longitudinal direction of the first plate portion 321.

Figure 7:
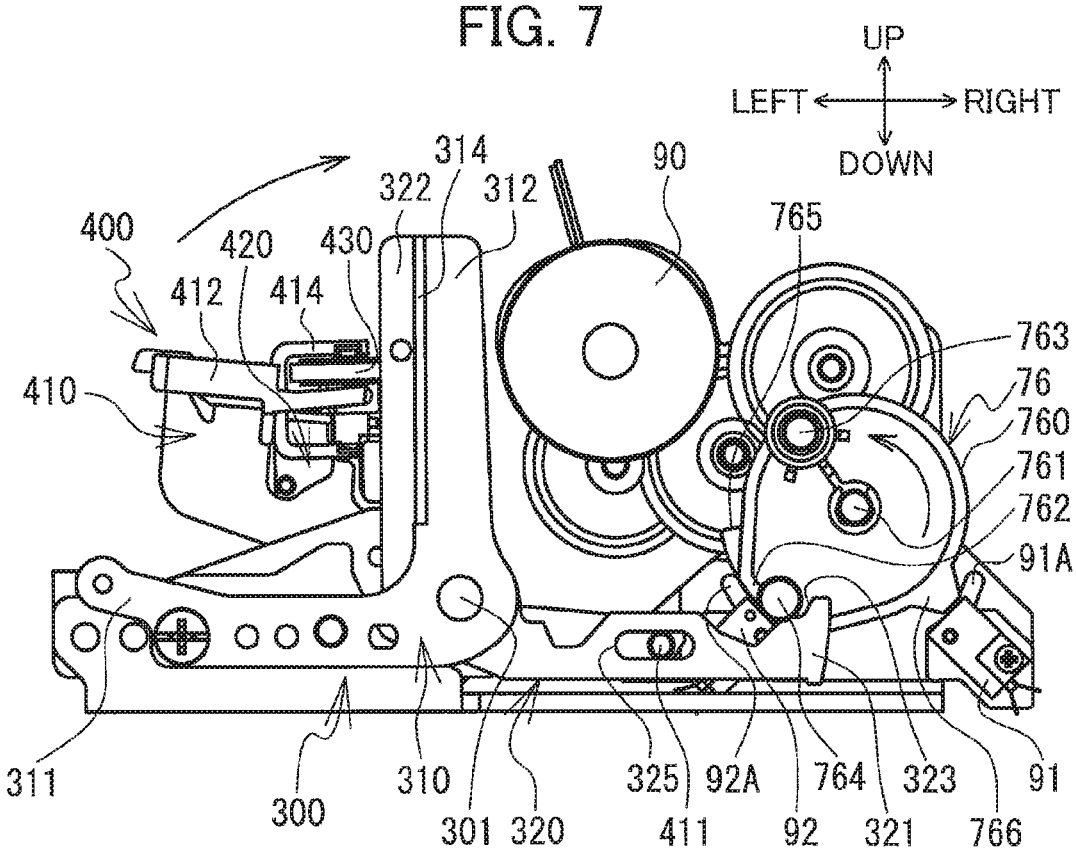
FIG. 7 is a view illustrating the full-cutting mechanism 300 and the conveying mechanism 400 of the cutting mechanism 80 in the printing device 1 according to the embodiment when the cam plate 760 is in a second angular position.
Figure 8:
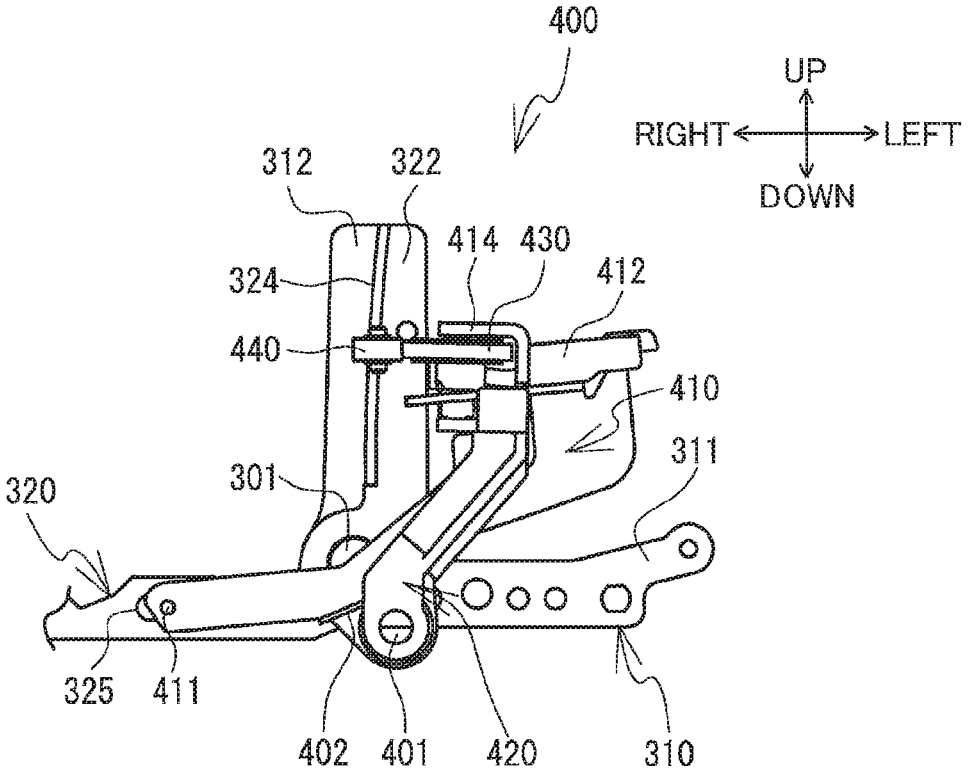
FIG. 8 is a view illustrating the conveying mechanism 400 of the cutting mechanism 80 in the printing device 1 according to the embodiment as viewed from the rear side thereof.

Next, the conveying mechanism 400 will be described with reference to FIGS. 5, 7, and 8. The conveying mechanism 400 is provided for conveying the tape 57 cut by the full-cutting mechanism 300 toward the discharge opening 111 (see FIG. 1). The conveying mechanism 400 includes a first link 410, a second link 420, a movable roller 430, and a follow roller 440. Note that FIG. 8 is a view of the conveying mechanism 400 as viewed from the rear side thereof.

The follow roller 440 is supported by a holder (not illustrated) provided on a rear surface the second plate portion 212 and is rotatable about an axis extending in the up-down direction. A rotational shaft 401 is provided below the follow roller 440. The rotational shaft 401 is a shaft portion having a front end fixed to the first plate portion 211 and extends rearward from the first plate portion 211. The rotational shaft 401 supports the first link 410 and the second link 420 juxtaposed in the front-rear direction.

The first link 410 is a plate-shaped member disposed rearward of the movable portion 320, and is elongated in the approximate left-right direction. The first link 410 and is pivotally movable about the rotational shaft 401 at a position frontward of the second link 420. The first link 410 has a right end portion that extends rightward from the rotational shaft 401 toward a position rearward of the guide hole 325. An engaging pin 411 is provided on the right end portion of the first link 410. The engaging pin 411 protrudes forward from the first link 410 and is inserted into the guide hole 325. The first link 410 has a left end portion that extends diagonally upward and leftward from the rotational shaft 401 toward a position leftward of the follow roller 440. An actuating mechanism 412 for rotating the movable roller 430 is disposed on an upper-left end portion of the first link 410.

The second link 420 extends diagonally upward and leftward from the rotational shaft 401. The second link 420 is pivotally movable about the rotational shaft 401 at a position rearward of the first link 410. The second link 420 is urged in a counterclockwise direction in FIG. 8 relative to the first link 410 by a torsion spring 402 attached to the rotational shaft 401. A roller holder 414 is provided on an upper-left end portion of the second link 420 for rotatably supporting the movable roller 430. The roller holder 414 is disposed at a position rightward of the actuating mechanism 412. The movable roller 430 opposes the follow roller 440 from the left side thereof. As the second link 420 is pivotally moved, the movable roller 430 can contact and separate from the movable roller 430. The movable roller 430 is rotatable about an axis extending substantially in the up-down direction.

As illustrated in FIGS. 2, 4, and 5, a first sensor 91 and a second sensor 92 are disposed below the cam plate 760.

The first sensor 91 is a mechanical sensor having a movable piece 91A and disposed diagonally below and rightward of the cam plate 760. The movable piece 91A has a proximal end pivotably supported by a main body of the first sensor 91, and a distal end extending upward toward the front circumferential surface 760A.

When the movable piece 91A is in its normal state where the movable piece 91A extends upward, the first sensor 91 outputs an OFF signal. When rotated in a clockwise direction from the normal state, the movable piece 91A is switched to a tilted state. When the movable piece 91A is in its tilted state, the first sensor 91 outputs an ON signal. In the following description, it will be stated that the first sensor 91 is ON when outputting an ON signal and OFF when outputting an OFF signal.

The second sensor 92 is a mechanical sensor having a movable piece 92A and is disposed diagonally below and leftward of the cam plate 760. The movable piece 92A has a proximal end pivotably supported by a main body of the second sensor 92, and has a distal end extending upward toward the rear circumferential surface 760B.

When the movable piece 92A is in its normal state where the movable piece 92A extends upward, the second sensor 92 outputs an OFF signal. When rotated in a counterclockwise direction from its normal state, the movable piece 92A is switched to a tilted state. When the movable piece 92A is in its tilted state, the second sensor 92 outputs an ON signal. In the following description, it will be stated that the second sensor 92 is ON when outputting an ON signal and OFF when outputting an OFF signal.

The cutting mechanism 80 is in a standby state when the cutter motor 90 is not driven (see FIGS. 2, 4, and 5). Hereinafter, positions of the movable portion 220, the movable portion 320, and the second link 420 when the cutting mechanism 80 is in the standby state will be called the first, second, and third standby positions, respectively. In the standby state of the cutting mechanism 80, a gap between the fixed blade 314 and the movable blade 324, a gap between the receiving member 213 and the cutting blade 223, and a gap between the follow roller 440 and the movable roller 430 are in communication with each other in the front-rear direction. The conveying path for the tape 57 in the tape discharge portion 110 (see FIG. 1) passes through these gaps. A printed tape 57 is conveyed along the fixed blade 314, the receiving member 213, and the follow roller 440.

When the cutting mechanism 80 is in its standby state, the cam plate 760 is in a position where the protruding portion 762 is directed leftward. The angular position of the cam plate 760 at this time is referred to as "reference angular position" (see FIG. 5). In this state, the first drive pin 763 contacts the arm portion 242 of the pressing spring 240 from the above while the arm portion 242 is engaged with the engaging plate 225, as illustrated in FIG. 4. Further, the second drive pin 764 contacts the guide portion 323 of the first plate portion 321 from the above, as illustrated in FIG. 5. At this time, both the movable piece 91A and the movable piece 92A are in their normal states, whereby both the first sensor 91 and the second sensor 92 output OFF signals.

<Operating Modes of Cutting Mechanism 80>

Next, operating modes of the components in the cutting mechanism 80 will be described with reference to FIGS. 4 through 9.

First, overview of operating modes of the half-cutting mechanism 200 will be described with reference to FIGS. 4, 6, and 9. In order to control the half-cutting mechanism 200 to cut a printed portion of the tape 57, a controller 20 provided in the printing device 1 controls the cutter motor 90 to be rotated in a forward direction (hereinafter referred to as "forward rotation"). When the cutter motor 90 makes forward rotation, the cam plate 760 is rotated in the clockwise direction in the drawings. As the cam plate 760 is rotated, the first drive pin 763 is also rotated in the first actuating direction about the shaft portion 761. The first actuating direction in the present embodiment is the clockwise direction in FIG. 6.

When rotated in the first actuating direction, the first drive pin 763 urges the arm portion 242 downward. Accordingly, the movable portion 220 in the first standby position is pivotally moved in the first actuating direction about the rotational shaft 201. In other words, the arm portion 242 transmits the force received from the first drive pin 763 to the movable portion 220.

Figure 6:
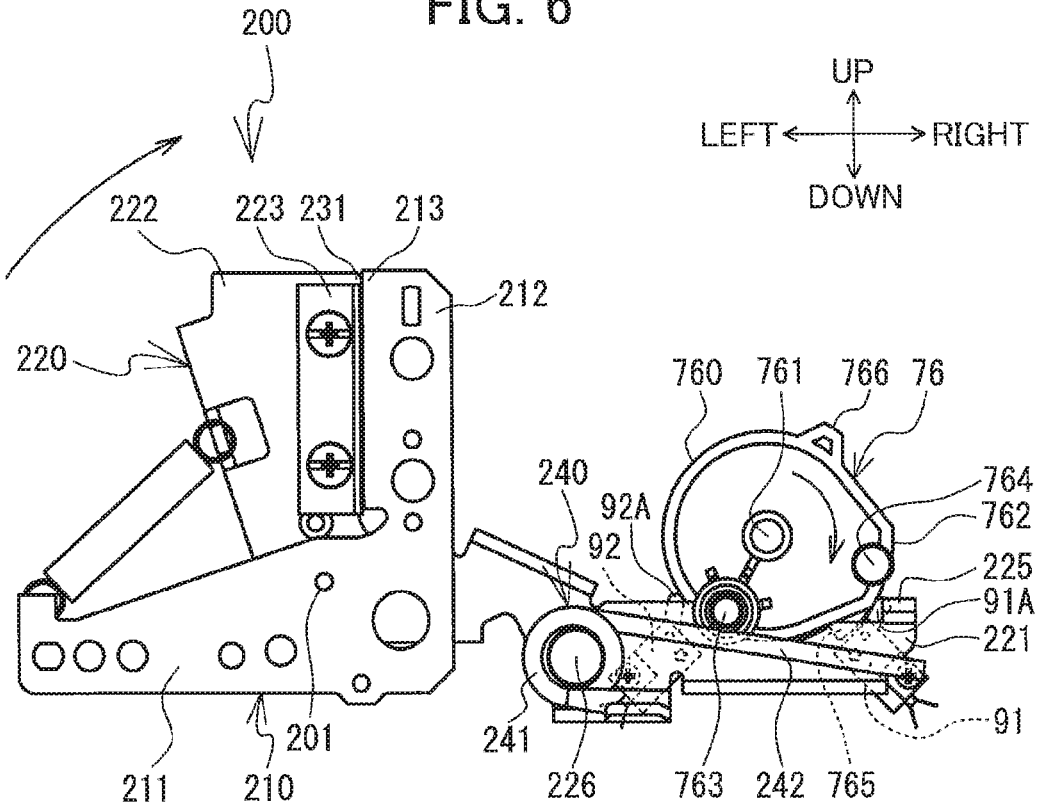
FIG. 6 is a view illustrating the half-cutting mechanism 200 of the cutting mechanism 80 in the printing device 1 according to the embodiment when the cam plate 760 is in a first angular position.

The movable portion 220 is moved rightward from the first standby position illustrated in FIG. 4 to a first cutting position illustrated in FIG. 6 to move the second plate portion 222 rightward. The first cutting position is a position of the movable portion 220 where the cutting blade 223 is adjacent to the receiving member 213. When the movable portion 220 is in the first cutting position, a gap narrower than the thickness of the printed tape 57 (for example, a gap approximately equivalent to the thickness of the release paper) is formed between the cutting blade 223 and the receiving member 213.

The cutting blade 223 presses the printed tape 57 that has been conveyed into the tape discharge portion 110 (see FIG. 1) against the receiving member 213 to cut through all layers of the printed tape 57 excluding the release paper. The angular position of the cam plate 760 at the moment the cutting blade 223 has completed cutting through all layers of the printed tape 57 except the release paper will be called "first angular position".

As the cam plate 760 is rotated in the first actuating direction from the reference angular position, the movable piece 91A is moved relative to the cam plate 760 along the front circumferential surface 760A (see FIG. 3). When the cam plate 760 is rotated to the first angular position illustrated in FIG. 6, the protruding portion 762 presses the movable piece 91A. The movable piece 91A changes from its normal state to the tilted state, and the first sensor 91 is switched from OFF to ON.

In the meantime, the movable piece 92A is moved relative to the cam plate 760 along the rear circumferential surface 760B (see FIG. 3), passing along a portion rearward of the second detection plate 766. Since the movable piece 92A is not pressed at this time, the second sensor 92 remains OFF.

Therefore, the controller 20 can determine that the cam plate 760 has been rotated to the first angular position and that the movable portion 220 is in the first cutting position when the first sensor 91 is ON and the second sensor 92 is OFF during forward rotation of the cutter motor 90 (see FIG. 9).

Thereafter, the controller 20 controls the cutter motor 90 to be rotated in a reverse direction (hereinafter referred to as "reverse rotation"). When the cutter motor 90 makes reverse rotation, the cam plate 760 is rotated in the counterclockwise direction. As the cam plate 760 is rotated, the first drive pin 763 is rotated in a second actuating direction about the shaft portion 761. The second actuating direction in the present embodiment is the counterclockwise direction in the drawings.

When the cam plate 760 is rotated in the second actuating direction to leave the first angular position, pressure applied to the movable piece 91A by the protruding portion 762 is released. Accordingly, the movable piece 91A changes from the tilted state to the normal state, and the first sensor 91 is switched from ON to OFF.

In the meantime, when the cam plate 760 rotated in the second actuating direction from the first angular position reaches the reference angular position and is rotated further in the second actuating direction, the movable piece 92A moving relative to the rear circumferential surface 760B is pressed by the first detection plate 765. Thus, as the cam plate 760 is rotated in the second actuating direction and separates from the reference angular position, the movable piece 92A changes from its normal state to a tilted state, and the second sensor 92 is switched from OFF to ON.

Subsequently, the controller 20 controls the cutter motor 90 to make forward rotation, causing the cam plate 760 to be rotated in the first actuating direction. When the cam plate 760 has reached its reference angular position, pressure applied to the movable piece 92A by the first detection plate 765 is released. Consequently, the movable piece 92A changes from the tilted state to the normal state, and the second sensor 92 is switched from ON to OFF.

Hence, when the first sensor 91 is OFF and the second sensor 92 is switched from OFF to ON and then back to OFF during operations of the half-cutting mechanism 200, the controller 20 can determine that the cam plate 760 has been rotated to the reference angular position and that the movable portion 220 has been positioned in the first standby position (see FIG. 9), and can halt driving of the cutter motor 90 at this time.

Through the above operations, the half-cutting mechanism 200 is returned to its standby state. Thereafter, the controller 20 drives the tape drive motor 26 (see FIG. 10) a prescribed amount, whereby the printed tape 57 that has been cut through all layers except the release paper is conveyed toward the discharge opening 111.

Next, operating modes of the full-cutting mechanism 300 and the conveying mechanism 400 will be described with reference to FIGS. 5 and 7 to 9. When controlling the full-cutting mechanism 300 to cut the printed tape 57, the controller 20 controls the cutter motor 90 to make reverse rotation. At this time, the cam plate 760 is rotated in the second actuating direction from the reference angular position.

When rotated in the second actuating direction, the second drive pin 764 urges the first plate portion 321 downward at the guide portion 323 to move the first plate portion 321 downward. As the first plate portion 321 is moved downward, the movable portion 320 is pivotally moved in the first actuating direction about the rotational shaft 301. The movable portion 320 is moved from its second standby position illustrated in FIG. 5 to a second cutting position illustrated in FIG. 7. The second cutting position is a position of the movable portion 320 when the movable blade 324 has crossed over the fixed blade 314.

Further, since the guide hole 325 is moved downward in accordance with downward movement of the first plate portion 321, the engaging pin 411 engaged in the guide hole 325 is also moved downward. As the engaging pin 411 is moved downward, the first link 410 is pivotally moved in the first actuating direction about the rotational shaft 401. The second link 420 is also rotated in association with the first link 410 via the torsion spring 402.

Accordingly, the second link 420 is moved from a third standby position illustrated in FIG. 5 to a conveying position illustrated in FIG. 8. In the conveying position of the second link 420, the movable roller 430 presses the printed portion of tape 57 against the follow roller 440.

Thus, as the cam plate 760 is rotated in the second actuating direction from the reference angular position to a second angular position, the movable roller 430 presses the printed portion of tape 57 that has been conveyed into the tape discharge portion 110 (see FIG. 1) against the follow roller 440. In this state, all layers of the printed portion of tape 57 are cut between the movable blade 324 and fixed blade 314. Here, the second angular position is the angular position of the cam plate 760 at the point that the movable roller 430 presses the printed tape 57 against the follow roller 440 and all layers of the printed tape 57 are cut completely through cooperation between the movable blade 324 and fixed blade 314.

An amount of movement (pivot amount) of the first link 410 is set greater than an amount of movement (pivot amount) of the second link 420 by a prescribed amount. Specifically, after the second link 420 has been moved to the conveying position, the first link 410 is moved by the prescribed amount further in the first actuating direction against the urging force of the torsion spring 402. Through this further movement of the first link 410, a compression spring (not illustrated) provided in the actuating mechanism 412 becomes compressed. Once the compression spring is compressed a prescribed amount, a clutch member (not illustrated) is disengaged, releasing the compression spring from its compressed state and halting movement of the first link 410.

At this time, an elastic force of the compressed spring urges the movable roller 430 to be rotated. Consequently, the movable roller 430 is rotated a prescribed amount while urging the printed portion of the tape 57 against the follow roller 440. Through the rotation of the movable roller 430, the cut piece of the printed tape 57 is conveyed toward the discharge opening 111. For convenience, the following description will assume that the movable roller 430 has been rotated when the second link 420 is in the conveying position.

The movable piece 92A is pressed by the first detection plate 765 as the cam plate 760 is rotated in the second actuating direction from the reference angular position. When the cam plate 760 has separated from the reference angular position by rotating in the second actuating direction, the movable piece 92A changes from the normal state to the tilted state, and the second sensor 92 is switched from OFF to ON. When the cam plate 760 rotated in the second actuating direction from the reference angular position reaches the second angular position, the movable piece 91A is pressed by the second detection plate 766. Accordingly, the movable piece 91A changes from the normal state to the tilted state, and the first sensor 91 is switched from OFF to ON.

Therefore, when both the first sensor 91 and the second sensor 92 are ON during reverse rotation of the cutter motor 90, the controller 20 can determine that the cam plate 760 has been rotated to the second angular position, the movable portion 320 is in the second cutting position, and the second link 420 is in the conveying position (see FIG. 9), and can halt driving of the cutter motor 90.

Thereafter, the controller 20 controls the cutter motor 90 to make forward rotation to rotate the cam plate 760 in the first actuating direction from the second angular position. When the cam plate 760 separates from the second angular position by rotating in the first actuating direction, pressure applied by the second detection plate 766 to the movable piece 91A is released and the movable piece 91A changes from its tilted state to its normal state. Accordingly, the first sensor 91 is switched from ON to OFF.

In the meantime, the cam plate 760 rotating in the first actuating direction from the second angular position arrives at the reference angular position. At this time, pressure applied by the first detection plate 765 to the movable piece 92A is released, allowing the movable piece 92A to change from its tilted state to its normal state. Accordingly, the second sensor 92 is switched from ON to OFF.

Hence, when both the first sensor 91 and the second sensor 92 are switched to OFF during operations of the full-cutting mechanism 300 and the conveying mechanism 400, the controller 20 can determine that the cam plate 760 has been rotated to the reference angular position (see FIG. 9) and can halt driving of the cutter motor 90.

Further, as the movable portion 320 is pivotally moved, the engaging pin 411 is moved upward and the first link 410 and the second link 420 are pivotally moved in the second actuating direction about the rotational shaft 401. When the second link 420 begins to be moved from the conveying position toward the third standby position, i.e., immediately before the movable roller 430 separates from the printed portion of the tape 57, a pawl member (not illustrated) provided on the first link 410 rotates the movable roller 430 a prescribed amount. The rotating movable roller 430 reliably conveys the cut piece of tape 57 further toward the discharge opening 111.

<Electrical Configuration of Printing Device 1>

Figure 10:
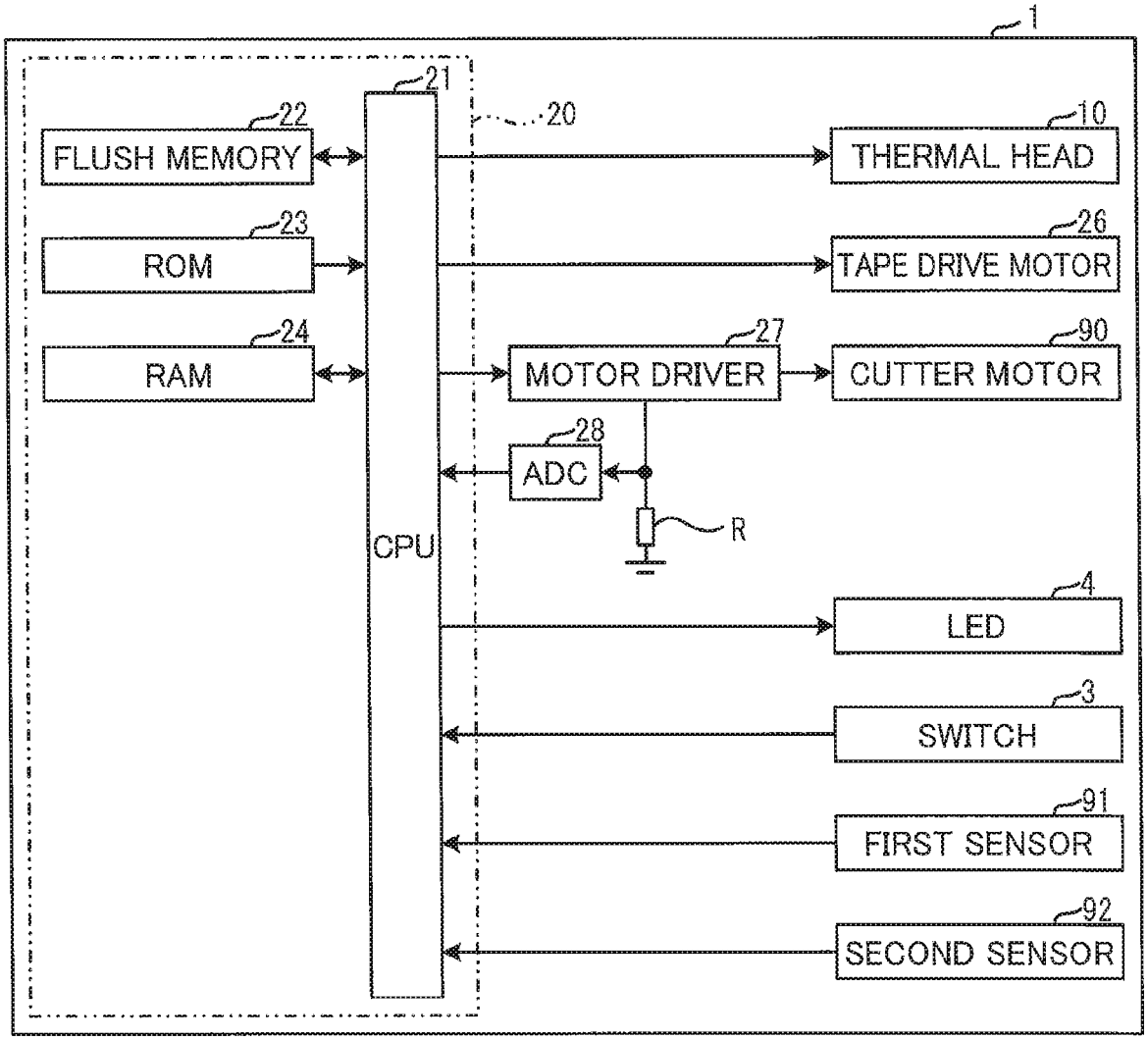
FIG. 10 is a block diagram illustrating an electrical configuration of the printing device 1 according to the embodiment.

Next, an electrical configuration of the printing device 1 will be described with reference to FIG. 10. As described above, the printing device 1 includes the controller 20. The controller 20 includes a CPU 21, a flash memory 22, a ROM 23, a RAM 24, and the like. The CPU 21 performs overall control of the printing device 1. The flash memory 22, the ROM 23, and the RAM 24 are connected to the CPU 21. The flash memory 22 stores therein programs and the like for the CPU 21 to execute a main process (described later). The ROM 23 stores therein various parameters that the CPU 21 requires when executing the various programs. The RAM 24 stores therein temporary data, such as timers, counters, and the like.

The switches 3, the first sensor 91, the second sensor 92, and an A/D converter (abbreviated as "ADC" in FIG. 10) 28 are also connected to the CPU 21. The A/D converter 28, the switches 3, the first sensor 91, and the second sensor 92 input information necessary for control into the CPU 21.

The thermal head 10, the tape drive motor 26, the LED 4, and a motor driver 27 are also connected to the CPU 21. The CPU 21 outputs information necessary for controlling the thermal head 10, the tape drive motor 26, the motor driver 27, and the LED 4.

The motor driver 27 is connected to the cutter motor 90, the A/D converter 28, and one end of a resistor R. The motor driver 27 is a driver device for driving the cutter motor 90 in accordance with control signals outputted from the CPU 21. The motor driver 27 supplies electric current to the cutter motor 90 and conducts current of the same value to the resistor R. At this time, a voltage corresponding to the conducted electric current is generated across both ends of the resistor R.

The A/D converter 28 converts the analog voltage level generated in the resistor R to a digital value and outputs this value to the CPU 21. Accordingly, the CPU 21 can identify the voltage generated across the both ends of the resistor R based on the digital value obtained from the A/D converter 28, and can also detect the electric current supplied to the cutter motor 90 based on the relationship between the identified voltage and the resistor R. Therefore, the CPU 21 can detect, using the A/D converter 28, when the current supplied to the cutter motor 90 is an overcurrent.

<Main Process>

Next, the main process executed by the CPU 21 will be described with reference to FIGS. 11 through 26. In the main process, the CPU 21 controls the printing device 1 to perform printing on the tape 57 and controls the cutting mechanism 80 to cut the printed tape 57.

First, counters and flags used in the main process will be described. The RAM 24 stores therein various flags and counters. The flags stored in the RAM 24 include an abnormal position flag, an overload flag, a calculation flag, a fixed-quantity flag, and a detection flag. The counters stored in the RAM 24 include an operating time counter, a first prescribed time counter, a second prescribed time counter, a first detection time counter, and a second detection time counter.

The flags are considered ON when storing the value "1" and OFF when storing the value "0". The CPU 21 sets the abnormal position flag to ON when determining that one of the movable portion 220 and the movable portion 320 is in an abnormal position, and sets the abnormal position flag to OFF when both the movable portion 220 and the movable portion 320 are in their correct positions. An abnormal position for the movable portion 220 and the movable portion 320 is any position not corresponding to the respective first cutting position and second cutting position after the cutter motor 90 makes forward rotation, and any position not corresponding to the respective first standby position and second standby position after the cutter motor 90 makes reverse rotation.

The CPU 21 sets the overload flag to ON when determining that the electric current conducted to the cutter motor 90 is an overcurrent, and sets the overload flag to OFF when determining that the electric current is not an overcurrent. The calculation flag, the fixed-quantity flag, and the detection flag will be described later.

The operating time counter is an up counter that counts the time that the movable portion 320 operates (hereinafter referred to as "operating time" during a full-cutting process (described later). The first prescribed time counter is a down counter that counts down a first prescribed time. The first prescribed time is stored in the ROM 23 in advance and is the time required for the movable portion 220 to be moved from the first standby position to the first cutting position or from the first cutting position to the first standby position. The second prescribed time counter is a down counter for counting down a second prescribed time. The second prescribed time is also pre-stored in the ROM 23 and is the time required for the movable portion 320 to be moved from the second standby position to the second cutting position or from the second cutting position to the second standby position. The first detection time counter and the second detection time counter will be described later.

The user operates the switches 3 in order for the printing device 1 to perform printing on the tape 57. Upon receiving operations on the switches 3, the CPU 21 executes the main process.

Figure 11:
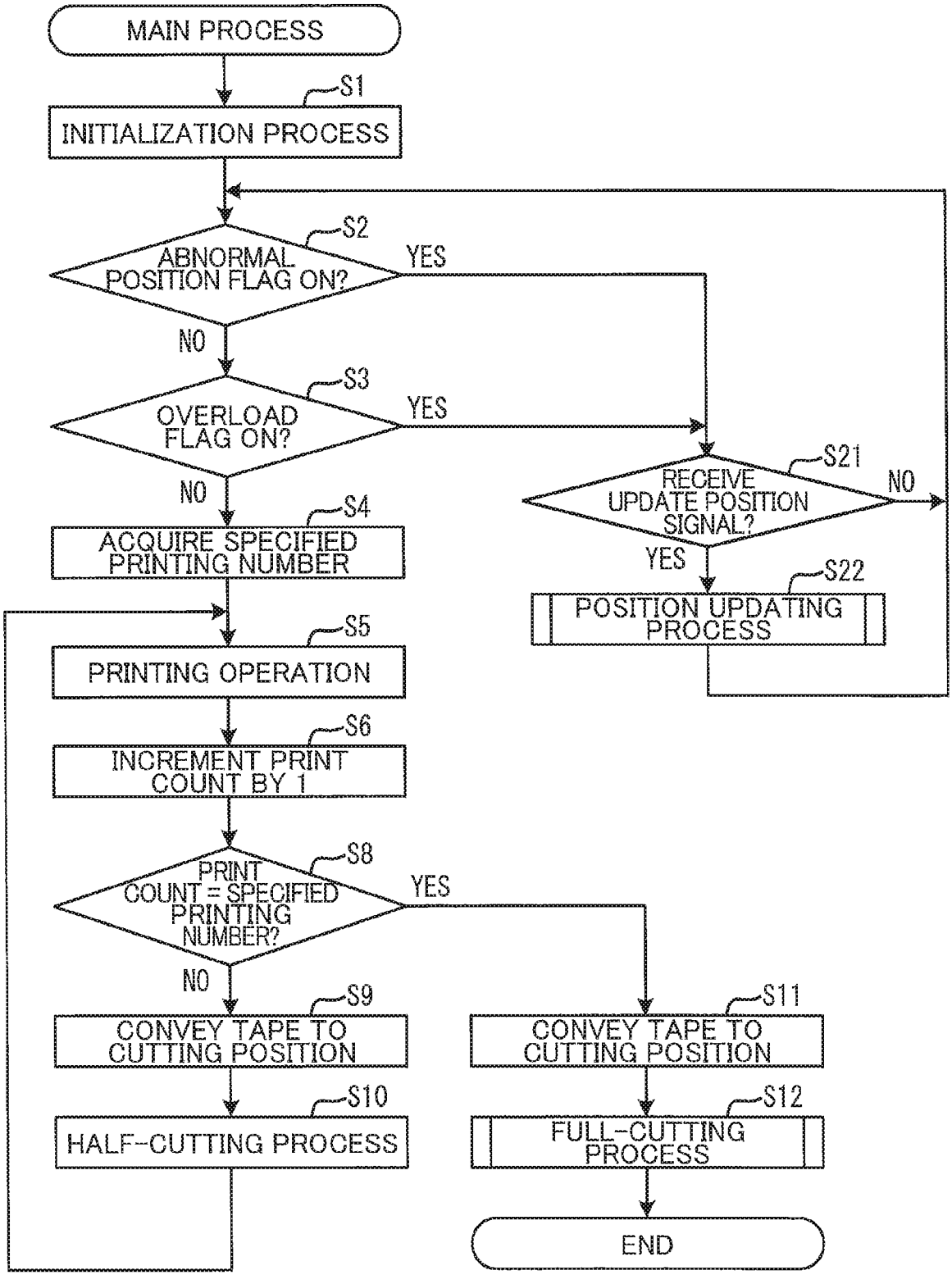
FIG. 11 is a flowchart illustrating a main process executed by a CPU 21 in the printing device 1 according to the embodiment.

In S1 of FIG. 11, the CPU 21 executes an initialization process. In the initialization process, the CPU 21 sets the position for each of the movable portion 220 and the movable portion 320 to the corresponding first standby position and second standby position by controlling the cutter motor 90 via the motor driver 27. Additionally, the CPU 21 resets values of all flags and counters and stores these values in the RAM 24. The CPU 21 also resets a value of a print count to "0" and stores this value in the RAM 24. The print count indicates the number of times the printing device 1 has executed a printing operation.

In S2 the CPU 21 determines whether the abnormal position flag is ON. When the CPU 21 determines that the abnormal position flag is ON (S2: YES), the CPU 21 advances to S21.

On the other hand, when the CPU 21 determines that the abnormal position flag is OFF (S2: NO), then in S3 the CPU 21 determines whether the overload flag is ON. When the CPU 21 determines that the overload flag is ON (S3: YES), the CPU 21 advances to S21.

On the other hand, when the CPU 21 determines that the overload flag is OFF (S3: NO), in S4 the CPU 21 acquires a specified printing number. The specified printing number denotes the number of times that the printing device 1 is to repeatedly execute a printing operation (S5) described later. The specified printing number is inputted by the user via the switches 3.

In S5 the CPU 21 executes a conventional printing operation.

Through this operation, text or the like is printed on the tape 57, for example. In S6 the CPU 21 increments the print count by 1 and stores the incremented print count in the RAM 24.

In S8 the CPU 21 determines whether the print count has reached the specified printing number. When the CPU 21 determines that the print count has not reached the specified printing number (S8: NO), in S9 the CPU 21 drives the tape drive motor 26 to convey the printed tape 57 to a cutting position at which the printed tape 57 is cut using the cutting mechanism 80.

In S10 the CPU 21 executes a half-cutting process. In the half-cutting process, the movable portion 220 of the cutting mechanism 80 cuts some layers of the printed tape 57. Subsequently, the CPU 21 returns to S5. The CPU 21 repeatedly executes the above process (S5 to S10) until the print count has reached the specified printing number (S8: YES). In other words, the CPU 21 repeatedly executes a printing operation and a half-cutting process.

When the CPU 21 determines that the print count reaches the specified printing number (S8: YES), in S11 the CPU 21 conveys the printed tape 57 to the cutting position. In S12 the CPU 21 executes a full-cutting process. In the full-cutting process, the movable portion 320 of the cutting mechanism 80 cuts through all layers of the printed tape 57. Upon completion of the full-cutting process, the CPU 21 ends the main process.

The half-cutting process is substantially identical to the full-cutting process of S12 described later, except the CPU 21 controls the movable portion 220 in the half-cutting process while controlling the movable portion 320 in the full-cutting process. An overview of the operating modes for each process is described above. In the present embodiment, only the full-cutting process will be described, while a description of the half-cutting process will be omitted.

Next, the full-cutting process will be described with reference to FIG. 12. In S51 of FIG. 12, the CPU 21 sets the operating time counter to "0" to begin timing. Next, the CPU 21 executes a forward process in S52 and executes a reverse process in S53. Subsequently, the CPU 21 ends the full-cutting process and returns to the main process.

Figure 13:
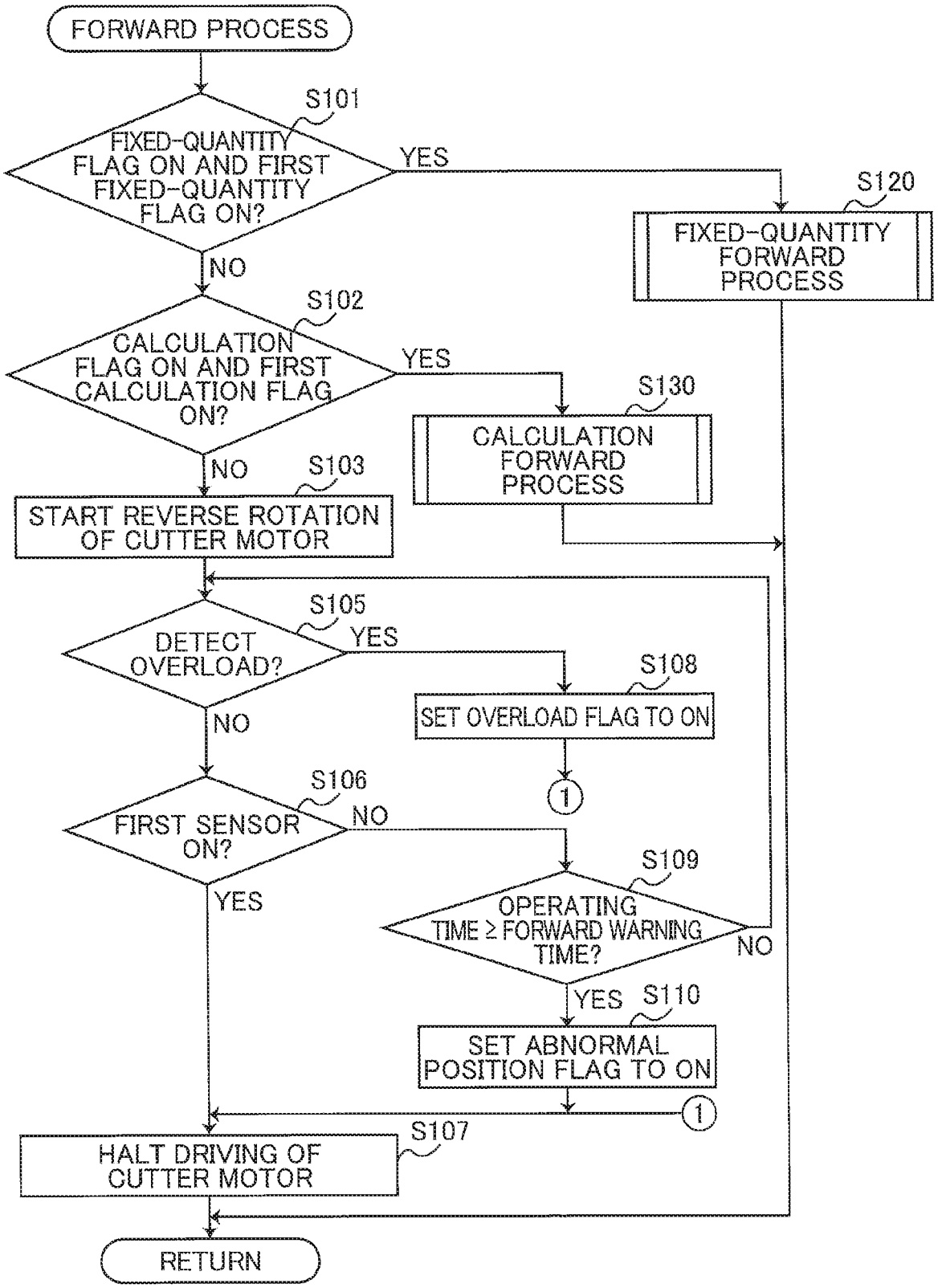
FIG. 13 is a flowchart illustrating a forward process in the full-cutting process executed by the CPU 21 in the printing device 1 according to the embodiment.

The forward process will be described next with reference to FIG. 13. In the forward process, the movable portion 320 is moved from the second standby position toward the second cutting position.

In S101 of FIG. 13, the CPU 21 determines whether both the fixed-quantity flag and a first fixed-quantity flag (described later) are ON. When the CPU 21 determines that at least one of the fixed-quantity flag and the first fixed-quantity flag is not ON (S101: NO), in S102 the CPU 21 determines whether both the calculation flag and a first calculation flag (described later) are ON. As will be described later, the fixed-quantity flag, the first fixed-quantity flag, the calculation flag, and the first calculation flag are all OFF (S101: NO and S102: NO) when both the first sensor 91 and the second sensor 92 are operating normally. Thus, when the first sensor 91 and the second sensor 92 are operating normally, in S103 the CPU 21 control the cutter motor 90 to start reverse rotation.

At this time, the movable portion 320 begins to be moved toward the fixed portion 310. In S105 the CPU 21 determines whether an overload on the cutter motor 90 has been detected. An overload on the cutter motor 90 is detected when the electric current supplied to the cutter motor 90 is an overcurrent. When the CPU 21 determines that an overload has been detected (S105: YES), in S108 the CPU 21 sets the overload flag to ON and advances to S107.

When an overload on the cutter motor 90 has not been detected (S105: NO), in S106 the CPU 21 determines whether the first sensor 91 is ON. When the first sensor 91 is determines to be OFF (S106: NO), in S109 the CPU 21 determines whether the operating time has reached a forward warning time. The CPU 21 makes the determination in S109 based on the value of the operating time counter that was set in S51 of FIG. 12. The forward warning time is pre-stored in the ROM 23 and is set sufficiently greater than the second prescribed time. When the operating time has not reached the forward warning time (S109: NO), the CPU 21 returns to S105.

When the operating time has reached the forward warning time (S109: YES), then the first sensor 91 remains OFF despite the fact that a time sufficiently longer than the second prescribed time has elapsed. Since the first sensor 91 is OFF, the movable portion 320 is determined to be not in the second cutting position but in an abnormal position. Accordingly, in S110 the CPU 21 sets the abnormal position flag to ON and subsequently advances to S107.

On the other hand, when the CPU 21 determines that the first sensor 91 is ON (S106: YES), the cam plate 760 is in the second angular position and the second sensor 92 is ON (see FIG. 7), as described above. Since both the first sensor 91 and the second sensor 92 are ON, in S107 the CPU 21 halts driving of the cutter motor 90 with the movable portion 320 in the second cutting position (see FIG. 9). Subsequently, the CPU 21 ends the forward process and returns to the full-cutting process.

Next, the reverse process will be described with reference to FIGS. 14 and 15. The reverse process is a process for moving back the movable portion 320 from the second cutting position toward the second standby position.

Figure 14:
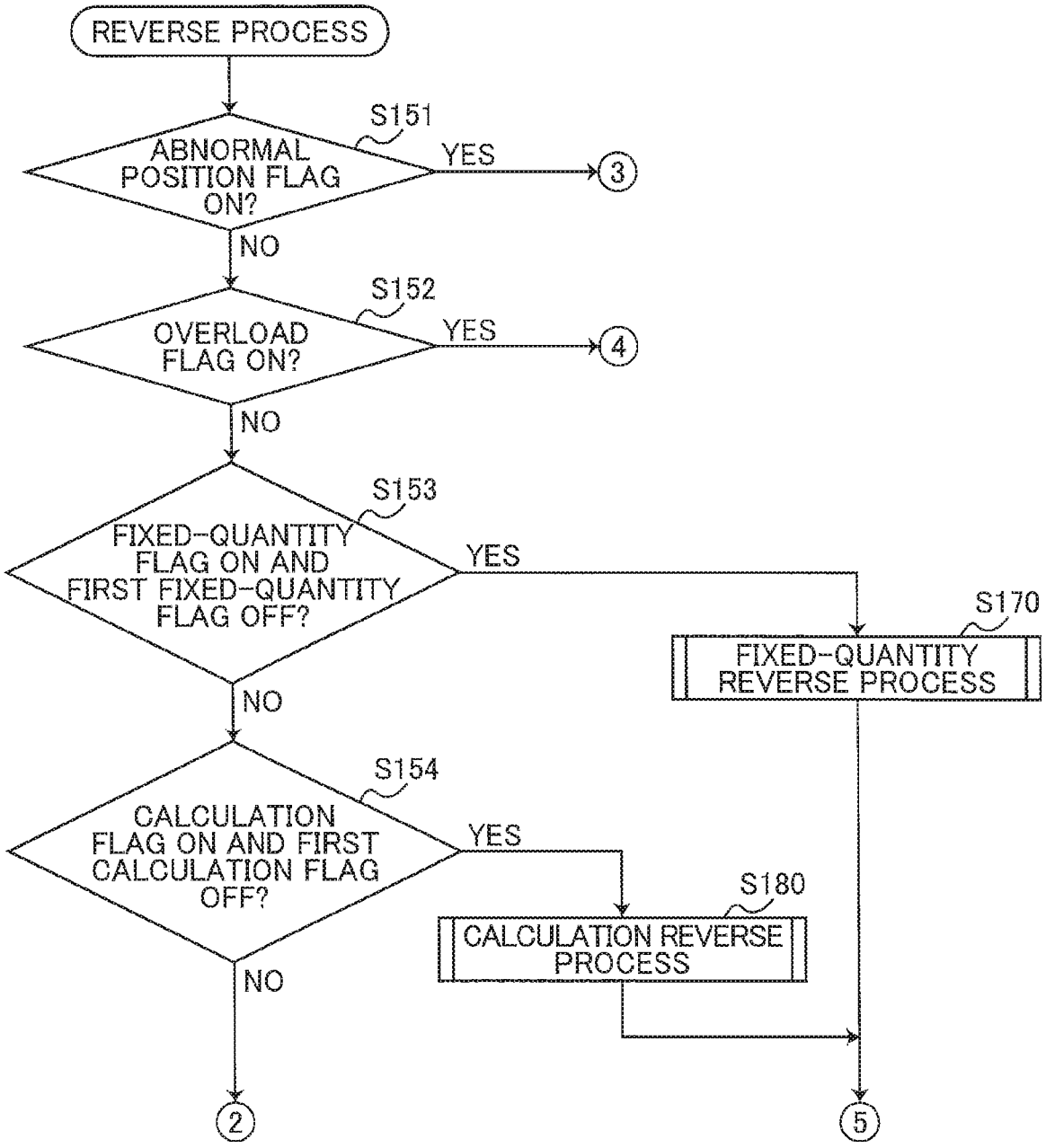
FIG. 14 is a flowchart illustrating a first part of a reverse process in the full-cutting process executed by the CPU 21 in the printing device 1 according to the embodiment.
Figure 15:
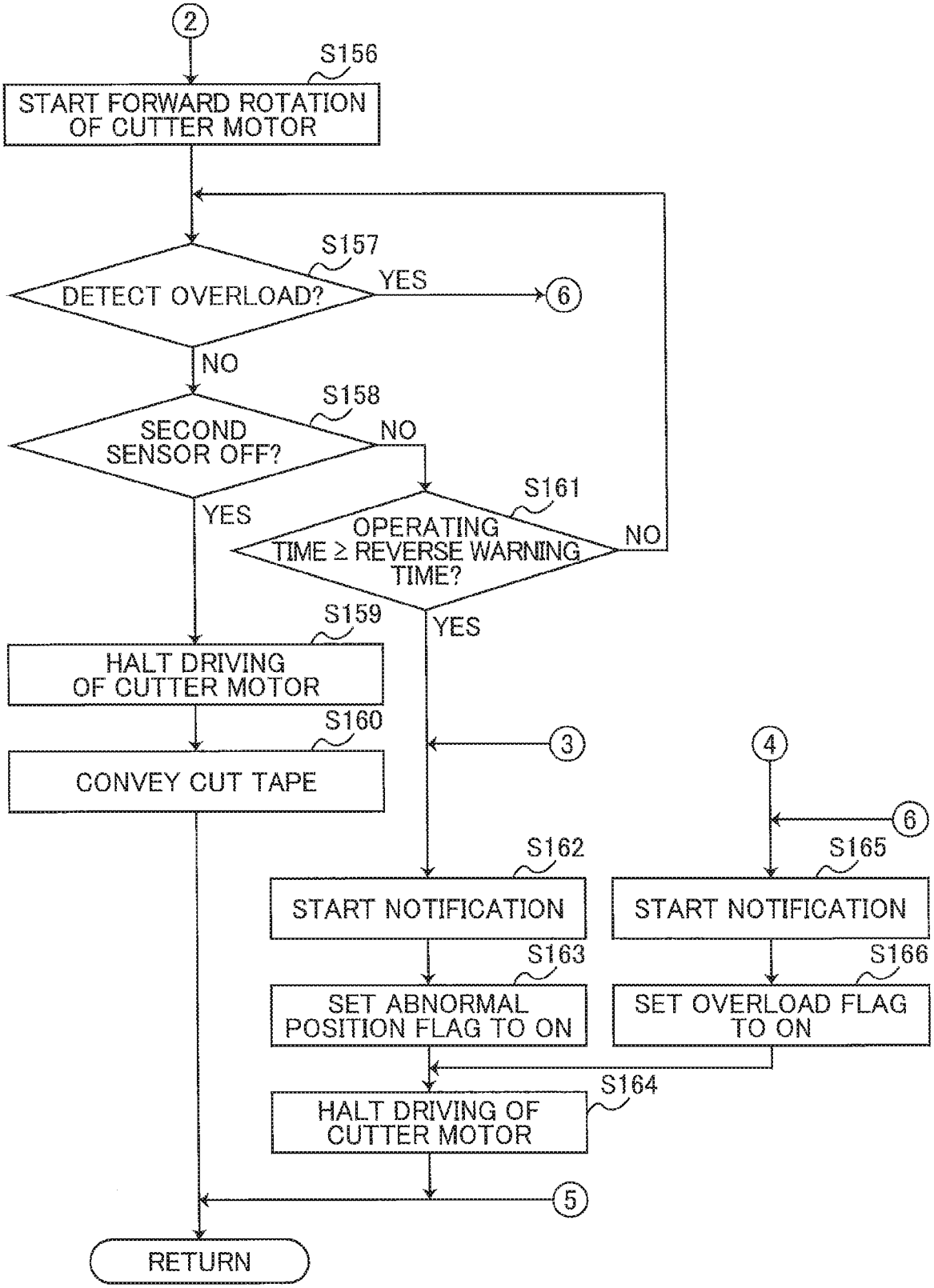
FIG. 15 is a flowchart illustrating a second part of the reverse process in the full-cutting process executed by the CPU 21 in the printing device 1 according to the embodiment.

In S151 of FIG. 14, the CPU 21 determines whether the abnormal position flag is ON. When the CPU 21 determines that the abnormal position flag is ON (S151: YES), the CPU 21 advances to the process in S162 of FIG. 15. On the other hand, when determining that the abnormal position flag is OFF (S151: NO), in S152 the CPU 21 determines whether the overload flag is ON. When the CPU 21 determines that the overload flag is ON (S152: YES), the CPU 21 advances to the process in S165 of FIG. 15.

On the other hand, when the overload flag is determined to be OFF (S152: NO), in S153 the CPU 21 determines whether the fixed-quantity flag is ON and the first fixed-quantity flag is OFF. When the fixed-quantity flag is not ON and/or the first fixed-quantity flag is not OFF (S153: NO), in S154 the CPU 21 determines whether the calculation flag is ON and the first calculation flag is OFF.

When the calculation flag is not ON and/or the first calculation flag is not OFF (S154: NO), the CPU 21 advances to the process of S156 in FIG. 15. As will be described later, when both the first sensor 91 and the second sensor 92 are operating normally, the fixed-quantity flag, the first fixed-quantity flag, the calculation flag, and the first calculation flag are all OFF (S153: NO and S154: NO). In S156 of FIG. 15, the CPU 21 controls the cutter motor 90 to start forward rotation. At this time, the movable portion 320 starts to be moved away from the fixed portion 310.

In S157 the CPU 21 determines whether overload on the cutter motor 90 has been detected. When the CPU 21 determines that overload on the cutter motor 90 has been detected (S157: YES), in S165 the CPU 21 starts notification by controlling the LED 4 to emit light. This notification using the LED 4 is halted when a position updating process (described later) has been performed. In S166 the CPU 21 sets the overload flag to ON, and subsequently advances to the process in S164.

On the other hand, when overload on the cutter motor 90 has not been detected (S157: NO), in S158 the CPU 21 determines whether the second sensor 92 is OFF. When the CPU 21 determines that the second sensor 92 is ON (S158: NO), in S161 the CPU 21 determines whether the operating time has reached a reverse warning time. The CPU 21 performs this determination in S161 based on the value of the operating time counter that was set in S51 of FIG. 12. The reverse warning time is pre-stored in the ROM 23 and is set sufficiently longer than twice the value of the second prescribed time. When the operating time has not reached the reverse warning time (S161: NO), the CPU 21 returns to S157.

When the operating time has reached the reverse warning time (S161: YES), then the second sensor 92 has remained ON despite the fact that a time sufficiently longer than twice the value of the second prescribed time has elapsed. Since the second sensor 92 is ON, the movable portion 320 is determined to be not in the second standby position but in an abnormal position. Accordingly, in S162 the CPU 21 starts notification by lighting the LED 4. This notification using the LED 4 is halted when performing the position updating process described later. In S163 the CPU 21 sets the abnormal position flag to ON and advances to S164. In S164 the CPU 21 halts driving of the cutter motor 90. Subsequently, the CPU 21 ends the reverse process and returns to the full-cutting process.

On the other hand, when the CPU 21 determines that the second sensor 92 is OFF (S158: YES), then the cam plate 760 is in the reference angular position and the first sensor 91 is OFF, as described above. Since both the first sensor 91 and the second sensor 92 are OFF, the movable portion 320 is determined to be in the second standby position (see FIG. 9). Accordingly, in S159 the CPU 21 halts driving of the cutter motor 90. In S160 the CPU 21 controls the conveying mechanism 400 to discharge the printed portion of the tape 57 to which full-cutting has been performed through the discharge opening 111. Subsequently, the CPU 21 ends the reverse process and returns to the full-cutting process.

In some cases, the first sensor 91 or the second sensor 92 cannot detect that the movable portion 220 is in the first cutting position or the first standby position or that the movable portion 320 is in the second cutting position or second standby position. That is, one of the first sensor 91 and the second sensor 92 may malfunction if the printing device 1 is dropped, for example, causing the first sensor 91 or the second sensor 92 to become displaced from its proper position relative to the cutting mechanism 80.

When one of the first sensor 91 and the second sensor 92 has malfunctioned, the malfunctioning sensor cannot properly detect when the movable portion 220 is in the first cutting position or the first standby position, or when the movable portion 320 is in the second cutting position or the second standby position.

Thus, there may be cases in which the abnormal position flag is set to ON because the malfunctioning sensor did not make a detection before the operating time reached the forward warning time or the reverse warning time (S110, S163) and cases in which either the movable portion 220 is forcibly pressed against the fixed portion 210 or the movable portion 320 is forcibly pressed against the movable portion 320 due to the movable portion 220 or the movable portion 320 being in an abnormal position, causing an overload on the cutter motor 90 and the overload flag being set to ON (S108, S166).

Since the CPU 21 executes cutting operations based on detection results from the first sensor 91 and the second sensor 92, the cutting mechanism 80 cannot perform adequate cutting operations when one of the first sensor 91 and the second sensor 92 has malfunctioned.

When the user recognizes the notification using the LED 4 or when the cutting mechanism 80 does not perform an adequate cutting operation, the user performs a prescribed operation on the printing device 1 through the switches 3. Upon receiving input of the prescribed operation, the switches 3 transmit an update position signal to the CPU 21.

The user operates the switches 3 in order for the CPU 21 to perform the main process. The CPU 21 executes the main process upon receiving a start command via the switches 3. As illustrated in FIG. 11, the CPU 21 executes the initialization process in S1 and determines whether the abnormal position flag is ON or whether the overload flag is ON in S2 and S3. When one of the abnormal position flag and the overload flag is ON (S2: YES or S3: YES), in S21 the CPU 21 determines whether an update position signal has been received via the switches 3. When an update position signal has not been received (S21: NO), the CPU 21 returns to S2.

When an update position signal has been received (S21: YES), in S22 the CPU 21 executes the position updating process, and subsequently returns to S2.

Figure 16:
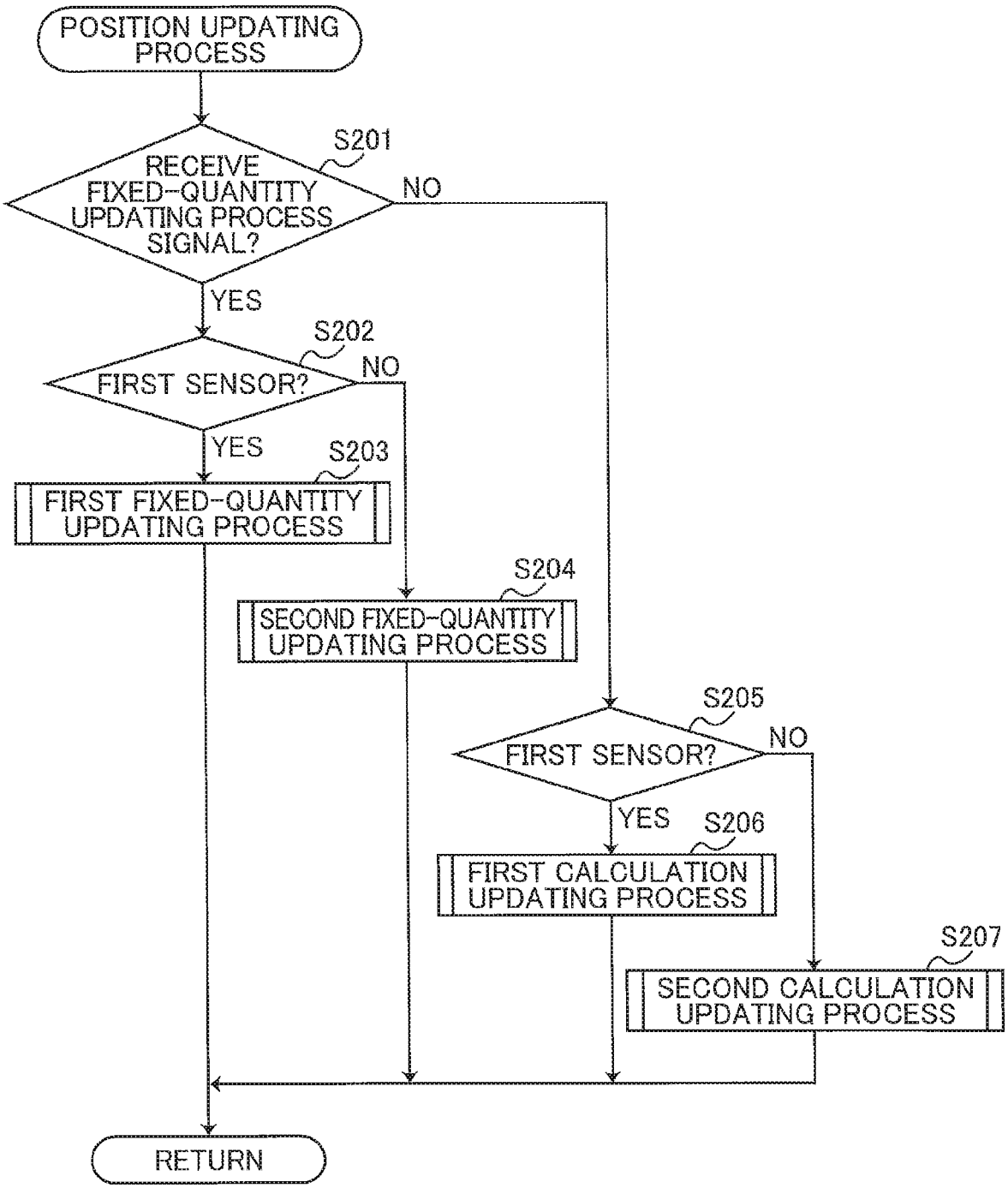
FIG. 16 is a flowchart illustrating a position updating process in the main process executed by the CPU 21 in the printing device 1 according to the embodiment.

Next, the position updating process will be described with reference to FIG. 16. The position updating process includes a fixed-quantity updating process and a calculation updating process. In S201 of FIG. 16, the CPU 21 determines whether a fixed-quantity updating process signal has been received. Here, the user can specify whether to execute the fixed-quantity updating process or the calculation updating process through an operation on the switches 3, and the CPU 21 receives the corresponding process signal from the switches 3. That is, the fixed-quantity updating process signal is outputted when the fixed-quantity updating process is to be executed.

When one of the fixed-quantity updating process and the calculation updating process is executed, the CPU 21 sets, as an updated position, a position to which the movable portion 220 or the movable portion 320 is moved based on a position detected by the non-malfunctioning sensor. The updated position will serve as the new start point for reciprocating movement (i.e., forward and reverse movement) of the movable portion 220 or the movable portion 320 in place of the position detected by the malfunctioning sensor.

In the fixed-quantity updating process, the CPU 21 sets, as the updated position, a position that the movable portion 220 or the movable portion 320 is moved during a corresponding first prescribed time or second prescribed time that is pre-stored in the ROM 23 from a position detected by the non-malfunctioning sensor.

In the calculation updating process, the CPU 21 calculates an offset between a position to which the movable portion 220 or the movable portion 320 is moved during the corresponding first prescribed time or second prescribed time from a position detected by the non-malfunctioning sensor, and a position detected by the malfunctioning sensor. Next, the CPU 21 sets a position shifted by the calculated offset from the position detected by the malfunctioning sensor as the updated position.

In the fixed-quantity updating process, the CPU 21 sets the updated position based solely on the time during which the movable portion 220 or the movable portion 320 is moved, rather than detection results from the malfunctioning sensor. In the calculation updating process, the CPU 21 sets the updated position using not only the time during which the movable portion 220 or the movable portion 320 is moved, but also detection results from the malfunctioning sensor.

A cutting operation based on an updated position set in the calculation updating process using the detection results of the malfunctioning sensor can be executed more precisely than a cutting operation based on an updated position set in the fixed-quantity updating process that does not use detection results from the malfunctioning sensor. Therefore, it is preferable to execute the fixed-quantity updating process in the position updating process only if the cutting mechanism 80 cannot perform a proper cut after an updated position has been set in the calculation updating process.

When the CPU 21 determines that the fixed-quantity updating process signal has been received (S201: YES), in S202 the CPU 21 determines whether the first sensor 91 is the target. The determination in S202 is made based on a user's operation. Specifically, the user visually recognizes a condition of the printing device 1 or recognizes a condition of cutting operations performed by the cutting mechanism 80 to determine which of the first sensor 91 and the second sensor 92 is not detecting properly, and operates the switches 3 to indicate one of the first sensor 91 and the second sensor 92 that is not detecting properly. Based on the user's operation, the switches 3 output a signal indicative of whether the first sensor 91 or the second sensor 92 has been selected to the CPU 21.

When the signal received from the switches 3 indicates that the first sensor 91 has been selected, the CPU 21 determines that the first sensor 91 is the target (S202: YES) and executes a first fixed-quantity updating process in S203. After completing the first fixed-quantity updating process in S203, the CPU 21 ends the position updating process and returns to the main process.

On the other hand, when the signal received from the switches 3 does not indicate that the first sensor 91 has been selected, the CPU 21 determines that the first sensor 91 is not the target (S202: NO) and that the second sensor 92 is the target. In this case, the CPU 21 executes a second fixed-quantity updating process in S204. After completing the second fixed-quantity updating process in S204, the CPU 21 ends the position updating process and returns to the main process.

When the CPU 21 determines that the fixed-quantity updating process signal has not been received (S201: NO), in S205 the CPU 21 determines whether the first sensor 91 is the target. This determination is similar to the determination in S202.

When the first sensor 91 is determined to be the target (S205: YES), the CPU 21 executes a first calculation updating process in S206. After completing the first calculation updating process in S206, the CPU 21 ends the position updating process and returns to the main process. When the first sensor 91 is determined to be not the target (S205: NO), the CPU 21 determines that the second sensor 92 is the target and executes a second calculation updating process in S207. After completing the second calculation updating process in S207, the CPU 21 ends the position updating process and returns to the main process.

Figure 17:
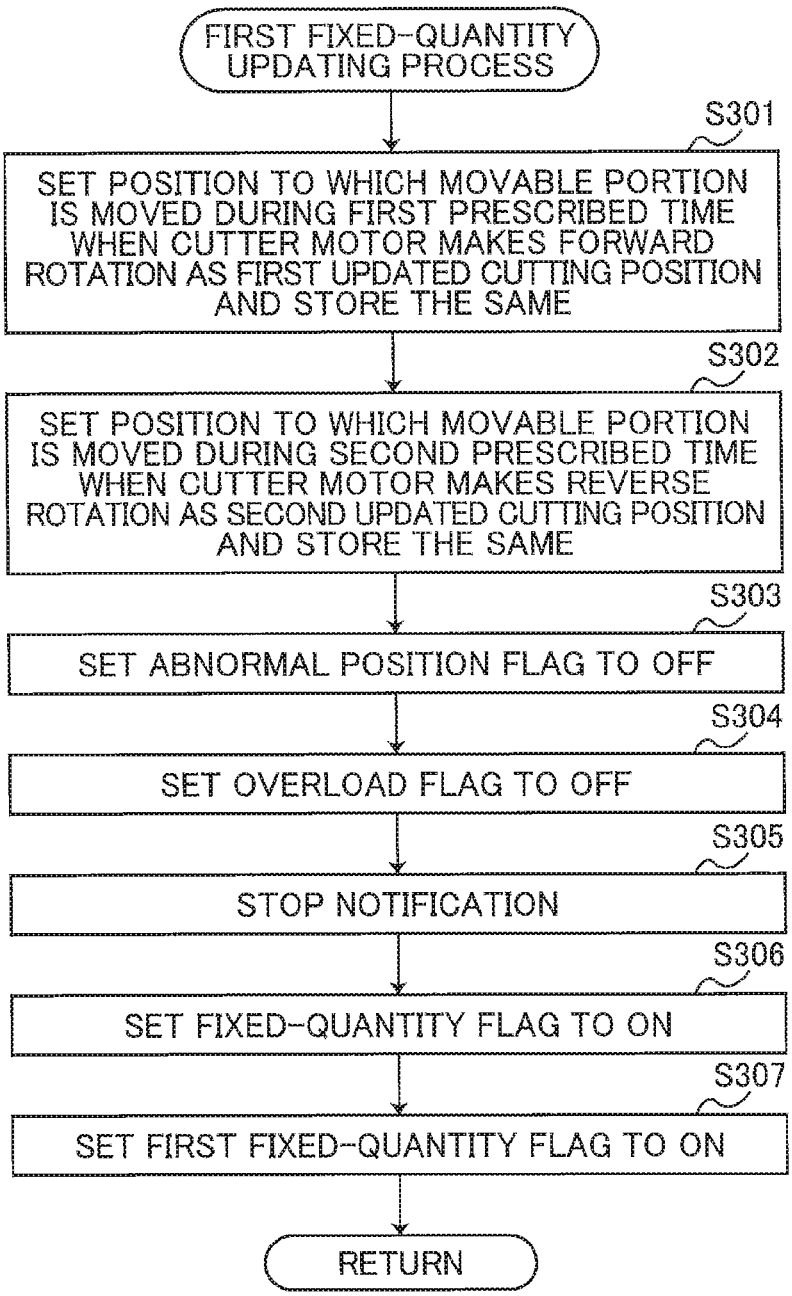
FIG. 17 is a flowchart illustrating a first fixed-quantity updating process in the position updating process executed by the CPU 21 in the printing device 1 according to the embodiment.

Next, the first fixed-quantity updating process will be described with reference to FIG. 17. In S301 of FIG. 17, the CPU 21 sets a position to which the movable portion 220 is moved from the first standby position during the first prescribed time when the cutter motor 90 makes forward rotation to a first updated cutting position, and stores the first updated cutting position in the flash memory 22. The first updated cutting position is the updated position that will replace the first cutting position.

In S302 the CPU 21 sets a position to which the movable portion 320 is moved from the second standby position during the second prescribed time when the cutter motor 90 makes reverse rotation as a second updated cutting position, and stores this second updated cutting position in the flash memory 22. The second updated cutting position is the updated position that will replace the second cutting position.

The CPU 21 sets the abnormal position flag to OFF in S303 and sets the overload flag to OFF in S304. In S305 the CPU 21 halts the notification using the LED 4. The CPU 21 sets the fixed-quantity flag to ON in S306 and sets the first fixed-quantity flag to ON in S307. Subsequently, the CPU 21 ends the first fixed-quantity updating process and returns to the position updating process.

The fixed-quantity flag is set to ON by storing "1" for the flag when either one of the first fixed-quantity updating process and the second fixed-quantity updating process was executed. The first fixed-quantity flag is set to ON by storing "1" as its value when the first fixed-quantity updating process was executed. Hence, when the fixed-quantity flag is ON and the first fixed-quantity flag is ON, the first updated cutting position is used in place of the first cutting position and the second updated cutting position is used in place of the second cutting position as start points for cutting operations with the cutting mechanism 80.

Figure 18:
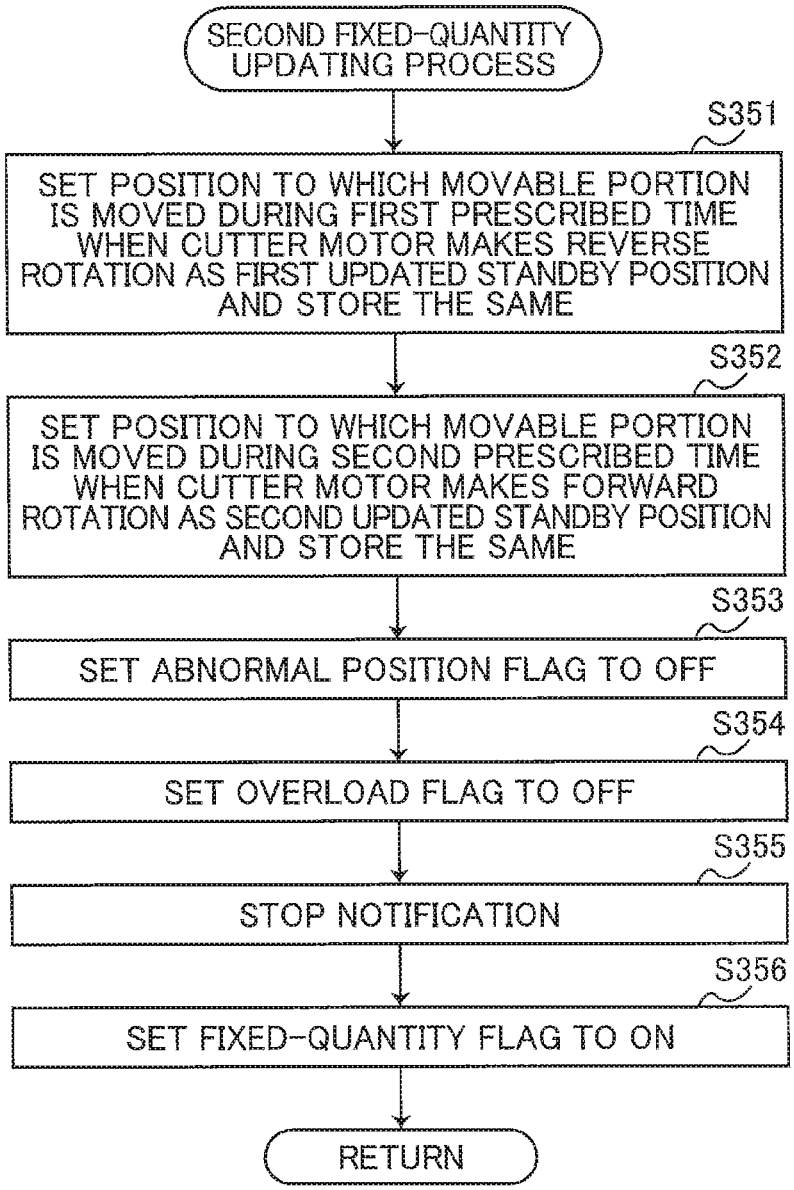
FIG. 18 is a flowchart illustrating a second fixed-quantity updating process in the position updating process executed by the CPU 21 in the printing device 1 according to the embodiment.

Next, the second fixed-quantity updating process will be described with reference to FIG. 18. In S351 of FIG. 18, the CPU 21 sets a position to which the movable portion 220 is moved from the first cutting position during the first prescribed time when the cutter motor 90 makes reverse rotation as a first updated standby position, and stores the first updated standby position in the flash memory 22. The first updated standby position is the updated position to be used in place of the first standby position.

In S352 the CPU 21 sets a position to which the movable portion 320 is moved from the second cutting position during the second prescribed time when the cutter motor 90 makes forward rotation as a second updated standby position, and stores the second updated standby position in the flash memory 22. The second updated standby position is the updated position to be used in place of the second standby position.

The CPU 21 sets the abnormal position flag to OFF in S353 and sets the overload flag to OFF in S354. In S355 the CPU 21 halts the notification by the lighting of the LED 4. In S356 the CPU 21 sets the fixed-quantity flag to ON. Subsequently, the CPU 21 ends the second fixed-quantity updating process and returns to the position updating process of FIG. 16. When the fixed-quantity flag is ON and the first fixed-quantity flag is OFF, the first updated standby position is used in place of the first standby position and the second updated standby position is used in place of the second standby position as start points for cutting operations with the cutting mechanism 80.

Figure 19:
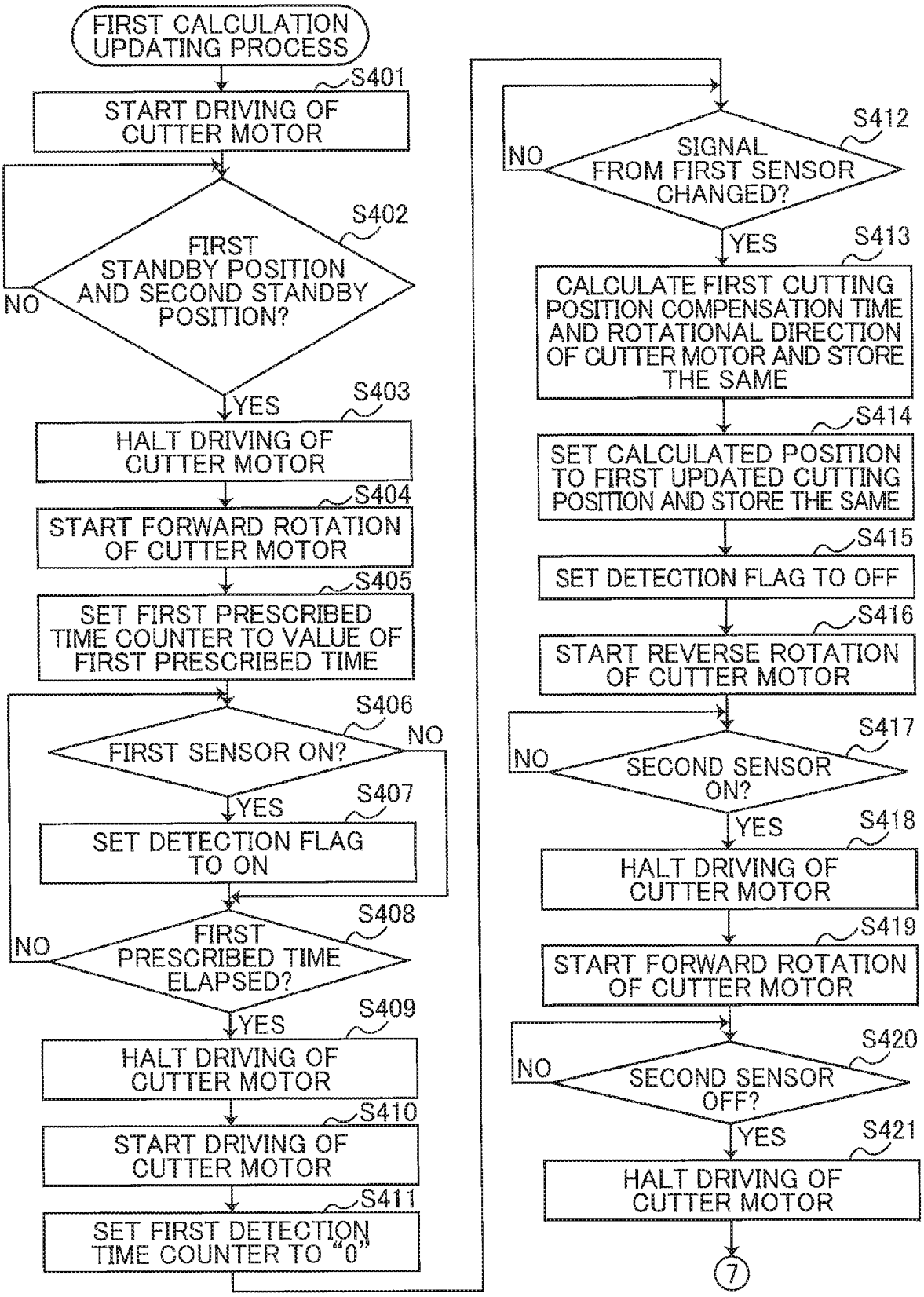
FIG. 19 is a flowchart illustrating a first part of a first calculation updating process in the position updating process executed by the CPU 21 in the printing device 1 according to the embodiment.

Next, the first calculation updating process will be described with reference to FIGS. 19 and 20. In S401 of FIG. 19, the CPU 21 starts driving the cutter motor 90. In S402 the CPU 21 determines whether the movable portion 220 is in the first standby position and the movable portion 320 is in the second standby position. The CPU 21 determines that the movable portion 220 is in the first standby position and that the movable portion 320 is in the second standby position when the non-malfunctioning second sensor 92 has been switched from ON to OFF. When the CPU 21 determines that at least one of the movable portion 220 and the movable portion 320 is not in the corresponding first standby position and the second standby position (S402: NO), the CPU 21 continues to repeat the process in S402.

When the CPU 21 determines that the movable portion 220 is in the first standby position and the movable portion 320 is in the second standby position (S402: YES), in S403 the CPU 21 halts driving of the cutter motor 90. In S404 the CPU 21 controls the cutter motor 90 to start forward rotation. In S405 the CPU 21 sets the first prescribed time counter to the value of the first prescribed time and starts counting down the first prescribed time.

In S406 the CPU 21 determines whether the first sensor 91 is ON. When the first sensor 91 is OFF (S406: NO), the CPU 21 advances to S408 and determines whether the first prescribed time has elapsed based on the value of the first prescribed time counter. When the value of the first prescribed time counter, which is a down counter, is not 0, indicating that the first prescribed time has not elapsed (S408: NO), the CPU 21 returns to S406.

When the CPU 21 determines that the first sensor 91 is ON (S406: YES), in S407 the CPU 21 sets the detection flag to ON. In the first calculation updating process, the detection flag is set to ON by storing the value "1" for the flag when the output signal from the first sensor 91 is changed before the first prescribed time elapsed while counting down the same. As will be described later, the detection flag is set to OFF after the updated position has been set by storing "0" for the flag. The CPU 21 subsequently advances to S408.

When the first prescribed time has elapsed (S408: YES), in S409 the CPU 21 halts driving of the cutter motor 90. At this time, the movable portion 220 is in the first cutting position. In S410 the CPU 21 begins driving the cutter motor 90 again.

A direction in which the CPU 21 controls the cutter motor 90 to be rotated is determined based on whether the detection flag is ON or OFF. When the detection flag is ON, a position of the movable portion 220 when the output signal of the first sensor 91 changed is between the first standby position and the first cutting position since the output signal of the first sensor 91 switched from OFF to ON while the movable portion 220 was moved from the first standby position toward the first cutting position. Accordingly, the CPU 21 controls the cutter motor 90 to start reverse rotation to move the movable portion 220 from the first cutting position toward the position at which the output signal of the first sensor 91 changes.

On the other hand, when the detection flag is OFF, the position of the movable portion 220 at which the output signal of the first sensor 91 changes is not between the first standby position and the first cutting position. Accordingly, the CPU 21 controls the cutter motor 90 to make further forward rotation to move the movable portion 220 from the first cutting position toward the position at which the output signal of the first sensor 91 changes.

In S411 the CPU 21 sets the first detection time counter to "0" to start counting a first detection time. In the first calculation updating process, the first detection time counter is an up counter for counting the time required for the movable portion 220 to be moved from the first cutting position to the position at which the first sensor 91 switches from OFF to ON.

In S412 the CPU 21 determines whether the output signal from the first sensor 91 has changed. Specifically, the CPU 21 determines whether the output signal has changed from OFF to ON when the first sensor 91 was OFF at the timing of S410 and whether the output signal has changed from ON to OFF when the first sensor 91 was ON at the timing of S410. When the output signal from the first sensor 91 has not changed (S412: NO), the CPU 21 continually repeats the determination in S412.

When the output signal from the first sensor 91 has changed (S412: YES), in S413 the CPU 21 calculates a first cutting position compensation time and the rotational direction for the cutter motor 90 and stores this information in the flash memory 22. The first cutting position compensation time is a time required for the movable portion 220 to be moved from the position at which the first sensor 91 switched from OFF to ON to the first cutting position and is calculated based on the value of the first detection time counter. The rotational direction of the cutter motor 90 is a direction for moving the movable portion 220 from the position at which the first sensor 91 switched from OFF to ON toward the first cutting position.

In S414 the CPU 21 sets a position of the movable portion 220 when moved from the position at which the first sensor 91 changed from OFF to ON based on the first cutting position compensation time and the rotational direction of the cutter motor 90 stored in the flash memory 22 as a first updated cutting position, and stores the first updated cutting position in the flash memory 22. The first updated cutting position is the updated position to be used in place of the first cutting position. In S415 the CPU 21 sets the detection flag to OFF.

In S416 the CPU 21 controls the cutter motor 90 to start reverse rotation in order to return the movable portion 220 to the first standby position. In S417 the CPU 21 determines whether the second sensor 92 has switched from OFF to ON. When the second sensor 92 has not been switched from OFF to ON (S417: NO), the CPU 21 repeats the determination in S417. When the second sensor 92 has switched from OFF to ON (S417: YES), in S418 the CPU 21 halts driving of the cutter motor 90.

In S419 the CPU 21 controls the cutter motor 90 to start forward rotation. In S420 the CPU 21 determines whether the second sensor 92 has switched from ON to OFF. While the second sensor 92 has not switched from ON to OFF (S420: NO), the CPU 21 continually repeats the determination in S420. When the second sensor 92 has switched from ON to OFF (S420: YES), in S421 the CPU 21 halts driving of the cutter motor 90.

Figure 20:
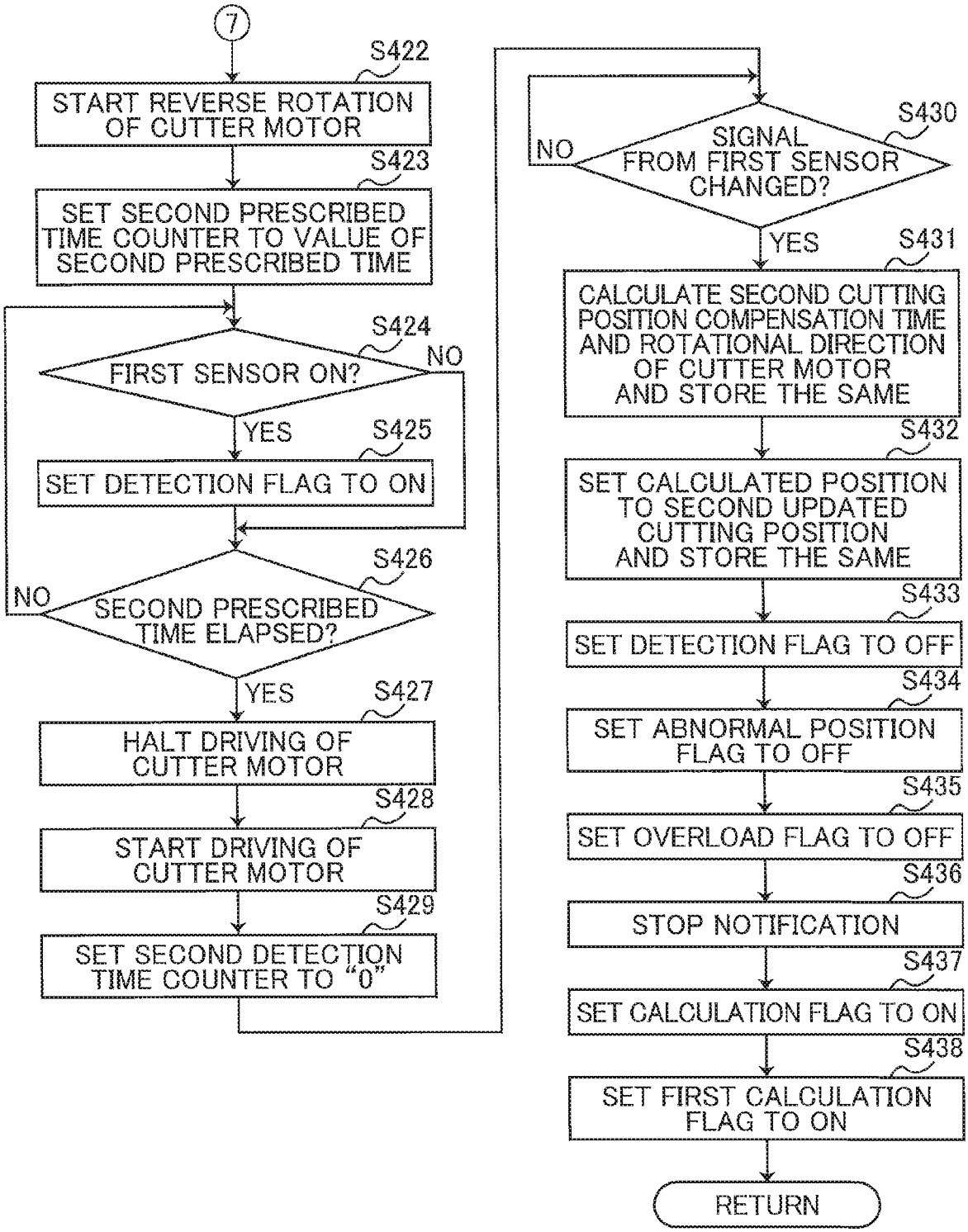
FIG. 20 is a flowchart illustrating a second part of the first calculation updating process in the position updating process executed by the CPU 21 in the printing device 1 according to the embodiment.

In S422 of FIG. 20, the CPU 21 controls the cutter motor 90 to start reverse rotation. Since the movable portion 220 is in the first standby position and the rotated angle of the cam plate 760 is at the reference angular position, the movable portion 320 is in the second standby position. At this time, the movable portion 320 is moved toward the fixed portion 310. In S423 the CPU 21 sets the second prescribed time counter to the value of the second prescribed time and starts counting down the second prescribed time.

As with the movable portion 220, in S424 the CPU 21 determines whether the first sensor 91 changes to ON before the second prescribed time has elapsed. When the first sensor 91 is ON (S424: YES), in S425 the CPU 21 sets the detection flag to ON. When the first sensor 91 is not ON (S424: NO), the CPU 21 does not set the detection flag to ON.

In S426 the CPU 21 determines whether the second prescribed time has elapsed. When the second prescribed time has not elapsed (S426: NO), the CPU 21 returns to S424. When the second prescribed time has elapsed (S426: YES), in S427 the CPU 21 halts driving of the cutter motor 90 with the movable portion 320 in the second cutting position.

Subsequently, in S428 the CPU 21 begins driving the cutter motor 90. A direction in which the cutter motor 90 is rotated is determined based on the state of the detection flag. Specifically, the CPU 21 controls the cutter motor 90 to make forward rotation when the detection flag is ON, whereas controls the cutter motor 90 to make reverse rotation when the detection flag is OFF. In this way, the movable portion 320 is moved from the second cutting position toward a position at which the output signal of the first sensor 91 changes.

In S429 the CPU 21 sets the second detection time counter to "0" and starts counting a second detection time. In the first calculation updating process, the second detection time counter is an up counter for measuring the time required for the movable portion 320 to be moved from the second cutting position to the position at which the first sensor 91 switches from OFF to ON. In S430 the CPU 21 determines whether the output signal of the first sensor 91 has changed. While the output signal has not changed (S430: NO), the CPU 21 repeats the determination in S430.

When the output signal of the first sensor 91 has changed (S430: YES), in S431 the CPU 21 calculates a second cutting position compensation time and the rotational direction for the cutter motor 90, and stores this information in the flash memory 22. The second cutting position compensation time is the time required for the movable portion 320 to be moved from the position at which the first sensor 91 changes from OFF to ON to the second cutting position and is calculated based on the value of the second detection time counter. As will be described later in detail, the second cutting position compensation time is the same value as the second detection time in the present embodiment. The rotational direction of the cutter motor 90 is a direction that the movable portion 320 is rotated from the position at which the first sensor 91 switches from OFF to ON toward the second cutting position.

In S432 the CPU 21 sets a position of the movable portion 320 moved from the position at which the first sensor 91 switches from OFF to ON based on the second cutting position compensation time and the rotational direction of the cutter motor 90 stored in the flash memory 22 as the second updated cutting position, and stores the second updated cutting position in the flash memory 22. The second updated cutting position is the updated position to be used in place of the second cutting position. In S433 the CPU 21 sets the detection flag to OFF.

The CPU 21 sets the abnormal position flag to OFF in S434 and sets the overload flag to OFF in S435. In S436 the CPU 21 halts the notification using lighting of the LED 4. The CPU 21 sets the calculation flag to ON in S437 and sets the first calculation flag to ON in S438. Subsequently, the CPU 21 ends the first calculation updating process and returns to the position updating process. When both the calculation flag and the first calculation flag are ON, the first updated cutting position is used in place of the first cutting position and the second updated cutting position is used in place of the second cutting position as start points for cutting operations with the cutting mechanism 80.

Next, the second calculation updating process will be described with reference to FIGS. 21 and 22. Steps in the second calculation updating process that are similar to those in the first calculation updating process will be only briefly described below.

Figure 21:
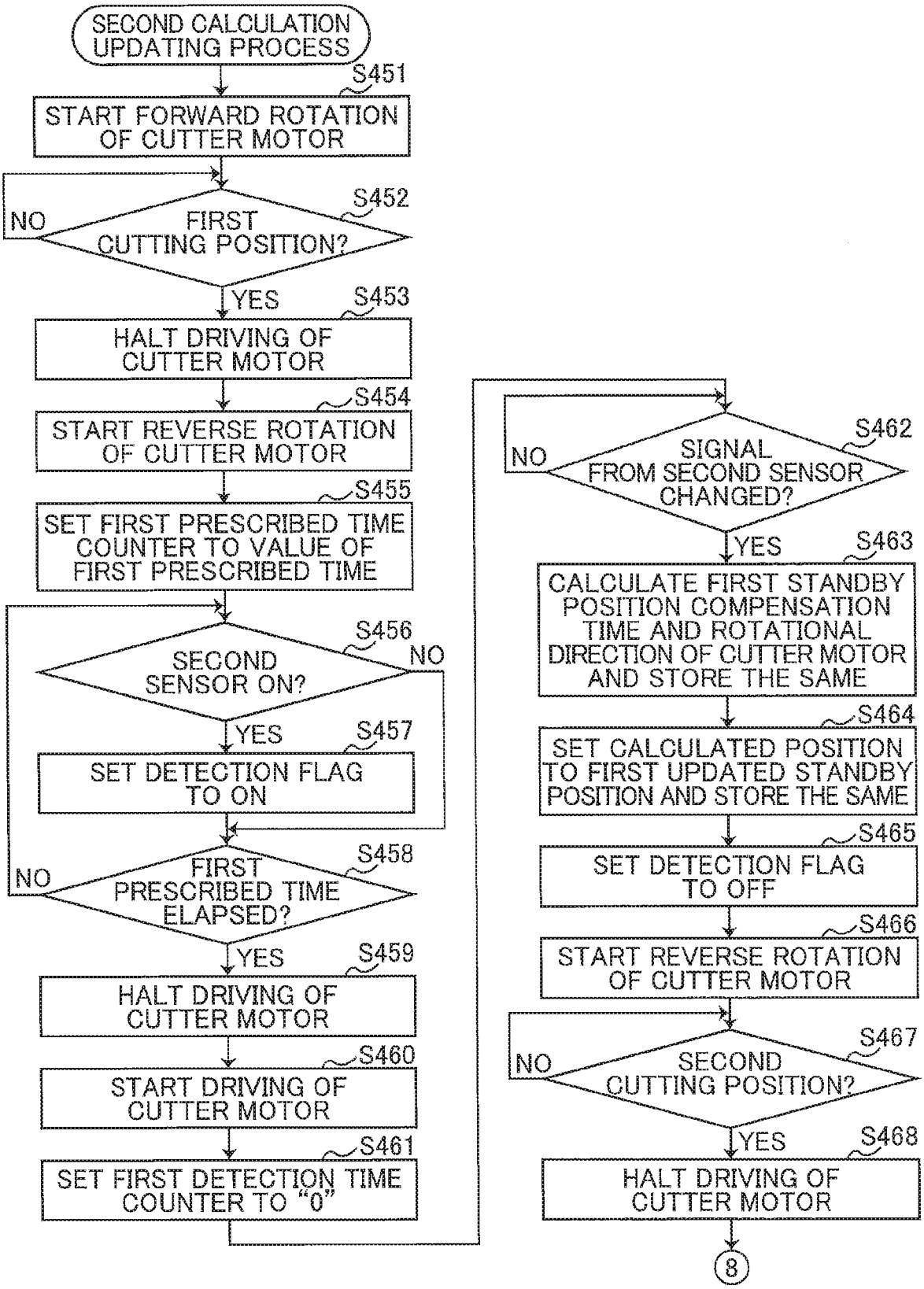
FIG. 21 is a flowchart illustrating a first part of a second calculation updating process in the position updating process executed by the CPU 21 in the printing device 1 according to the embodiment.

In S451 of FIG. 21, the CPU 21 controls the cutter motor 90 to make forward rotation. In S452 the CPU 21 determines whether the movable portion 220 is in the first cutting position. The CPU 21 determines that the movable portion 220 is in the first cutting position when the non-malfunctioning first sensor 91 is switched from OFF to ON. When the movable portion 220 is not in the first cutting position (S452: NO), the CPU 21 continues to repeat the determination in S452.

When the movable portion 220 is in the first cutting position (S452: YES), in S453 the CPU 21 halts driving of the cutter motor 90. In S454 the CPU 21 controls the cutter motor 90 to start reverse rotation. At this time, the movable portion 220 is moved in a direction away from the fixed portion 210. In S455 the CPU 21 sets the first prescribed time counter to the value of the first prescribed time to begin counting down the first prescribed time.

In S456 the CPU 21 repeatedly determines whether the second sensor 92 is ON until the first prescribed time has elapsed. When the CPU 21 determines that the second sensor 92 is ON (S456: YES), in S457 the CPU 21 sets the detection flag to ON. On the other hand, when the second sensor 92 is not ON (S456: NO), the CPU 21 does not set the detection flag to ON. In the second calculation updating process, the detection flag is set to ON by storing the value "1" for the flag when the output signal from the first sensor 91 is changed before the second prescribed time elapsed while counting down the same.

In S458 the CPU 21 determines whether the first prescribed time has elapsed and returns to S456 when the first prescribed time has not elapsed (S458: NO). When the first prescribed time has elapsed (S458: YES), in S459 the CPU 21 halts driving of the cutter motor 90 with the movable portion 220 in the first standby position. Subsequently, in S460 the CPU 21 starts driving the cutter motor 90. The direction in which the cutter motor 90 is rotated at this time is determined by the state of the detection flag. Specifically, the CPU 21 controls the cutter motor 90 to make forward rotation when the detection flag is ON, and controls the cutter motor 90 to make reverse rotation when the detection flag is OFF. The movable portion 220 is moved from the first standby position in the direction toward the position to be detected by the second sensor 92.

In S461 the CPU 21 sets the first detection time counter to "0" to start timing the first detection time. In the second calculation updating process, the first detection time counter is an up counter for counting the time that the movable portion 220 requires to be moved from the first standby position to the position at which the second sensor 92 is switched from ON to OFF. In S462 the CPU 21 determines whether the output signal of the second sensor 92 has changed and continues to repeat the determination in S462 while the output signal has not changed (S462: NO).

When the output signal from the second sensor 92 has changed (S462: YES), in S463 the CPU 21 calculates a first standby position compensation time and the rotational direction for the cutter motor 90 and stores this information in the flash memory 22. The first standby position compensation time is the time required for the movable portion 220 to be moved from the position at which the second sensor 92 switches from ON to OFF to the first standby position and is calculated based on the value of the first detection time counter. The rotational direction for the cutter motor 90 is the direction for moving the movable portion 220 from the position at which the second sensor 92 switches from ON to OFF to the first standby position.

In S464 the CPU 21 sets a position of the movable portion 220 moved from the position at which the second sensor 92 switches from ON to OFF based on the first standby position compensation time and the rotational direction for the cutter motor 90 those are stored in the flash memory 22 to a first updated standby position, and stores this first updated standby position in the flash memory 22. The first updated standby position is the updated position to be used in place of the first standby position. In S465 the CPU 21 sets the detection flag to OFF.

In S466 the CPU 21 controls the cutter motor 90 to start reverse rotation. In S467 the CPU 21 determines whether the movable portion 320 is in the second cutting position. The CPU 21 determines whether the movable portion 320 is in the second cutting position when the non-malfunctioning first sensor 91 has been switched from OFF to ON. The CPU 21 continues to repeat the determination in S467 while the movable portion 320 is not in the second cutting position (S467: NO). When the CPU 21 determines that the movable portion 320 is in the second cutting position (S467: YES), in S468 the CPU 21 halts driving of the cutter motor 90.

Figure 22:
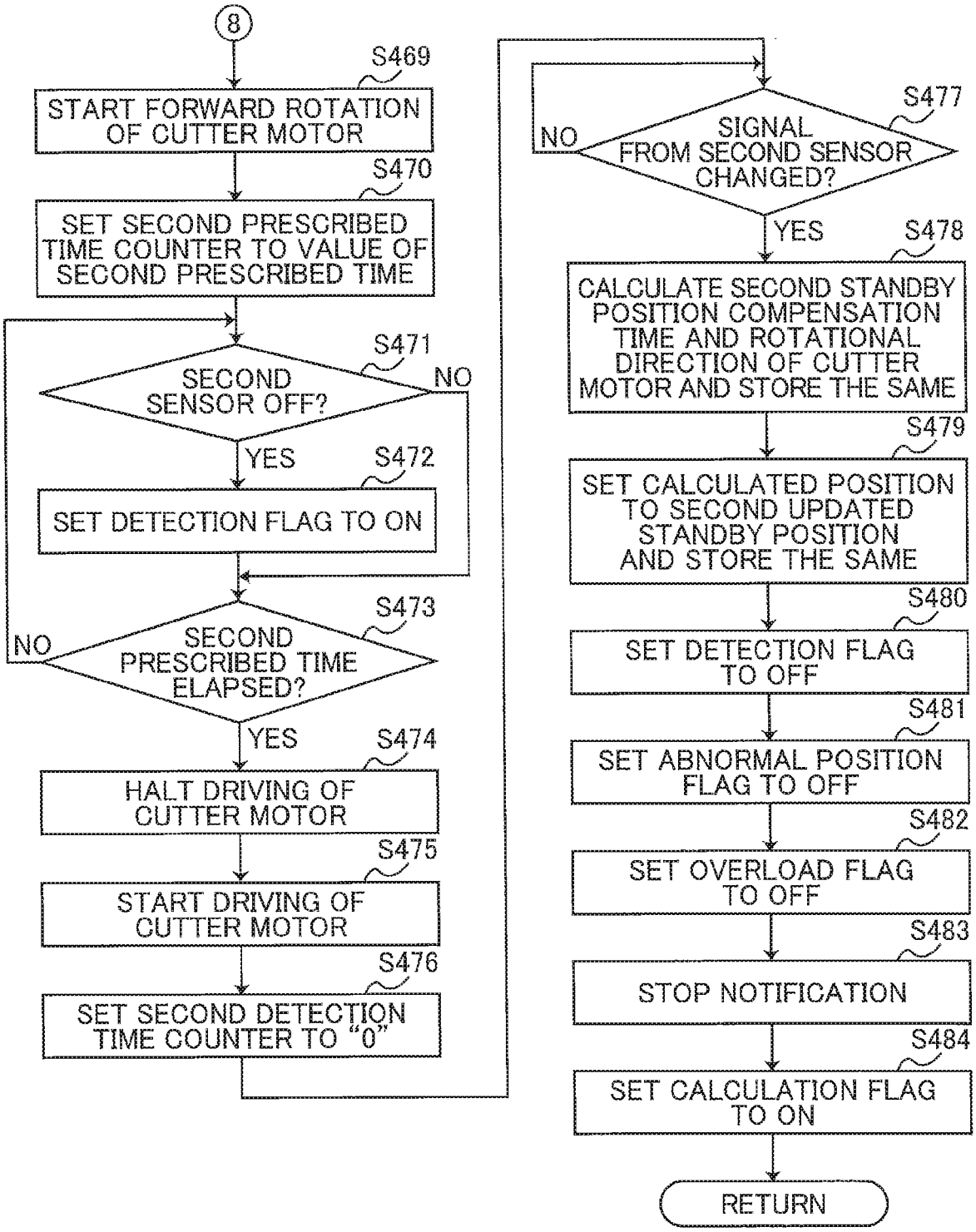
FIG. 22 is a flowchart illustrating a second part of the second calculation updating process in the position updating process executed by the CPU 21 in the printing device 1 according to the embodiment.

In S469 of FIG. 22, the CPU 21 controls the cutter motor 90 to start forward rotation. At this time, the movable portion 320 is moved in a direction away from the fixed portion 310. In S470 the CPU 21 sets the second prescribed time counter to the value of the second prescribed time to start counting down the second prescribed time.

In S471 the CPU 21 continuously determines whether the second sensor 92 has been switched to OFF until the second prescribed time has elapsed. When the CPU 21 determines that the second sensor 92 has been switched to OFF (S471: YES), in S472 the CPU 21 sets the detection flag to ON. When the second sensor 92 has not been switched to OFF (S471: NO), the CPU 21 does not set the detection flag to ON.

In S473 the CPU 21 determines whether the second prescribed time has elapsed, and returns to S471 while the second prescribed time has not elapsed (S473: NO). When the CPU 21 determines that the second prescribed time has elapsed (S473: YES), in S474 the CPU 21 halts driving of the cutter motor 90 with the movable portion 320 in the second standby position. Subsequently, in S475 the CPU 21 begins driving the cutter motor 90 again. The direction that the cutter motor 90 is rotated is determined based on the state of the detection flag. That is, the CPU 21 controls the cutter motor 90 to make reverse rotation when the detection flag is ON and controls the cutter motor 90 to make forward rotation when the detection flag is OFF. At this time, the movable portion 320 is moved from the second standby position toward the position at which the movable portion 320 will be detected by the second sensor 92.

In S476 the CPU 21 sets the second detection time counter to "0" to begin counting the second detection time. In the second calculation updating process, the second detection time counter is an up counter for measuring the time required for the movable portion 320 to be moved from the second standby position to the position at which the second sensor 92 switches from ON to OFF. In S477 the CPU 21 determines whether the output signal from the second sensor 92 has changed, and repeatedly performs the determination in S477 while the output signal has not changed (S477: NO).

When the output signal from the second sensor 92 has changed (S477: YES), in S478 the CPU 21 calculates a second standby position compensation time and the rotational direction for the cutter motor 90, and stores this information in the flash memory 22. The second standby position compensation time is the time required for the movable portion 320 to be moved from the position that the second sensor 92 changes from ON to OFF to the second standby position and is calculated based on the value of the second detection time counter. As will be described later in greater detail, the second standby position compensation time in the present embodiment is the same value as the second detection time. The rotational direction for the cutter motor 90 is the direction for moving the movable portion 320 from the position at which the second sensor 92 switches from ON to OFF toward the second standby position.

In S479 the CPU 21 sets a position of the movable portion 320 moved from the position at which the second sensor 92 switches from ON to OFF based on the second standby position compensation time and the rotational direction for the cutter motor 90 that are stored in the flash memory 22 as the second updated standby position, and stores the second updated standby position in the flash memory 22. The second updated standby position is the updated position to be used in place of the second standby position. In S480 the CPU 21 sets the detection flag to OFF.

Next, the CPU 21 sets the abnormal position flag to OFF in S481 and sets the overload flag to OFF in S482. In S483 the CPU 21 halts the notification using the LED 4. In S484 the CPU 21 sets the calculation flag to ON. Subsequently, the CPU 21 ends the second calculation updating process and returns to the position updating process. When the calculation flag is ON and the first calculation flag is OFF, the first updated standby position is used in place of the first standby position and the second updated standby position is used in place of the second standby position as start points for the cutting operation performed by the cutting mechanism 80.

Next, a forward process performed after executing the position updating process will be described. When the CPU 21 begins the forward process in the full-cutting process illustrated in FIG. 12, the CPU 21 first determines in S101 of FIG. 13 whether the fixed-quantity flag and the first fixed-quantity flag are ON.

When the fixed-quantity flag and the first fixed-quantity flag are both ON (S101: YES), then the first fixed-quantity updating process has been executed in the position updating process, and the second updated cutting position is to be used in place of the second cutting position as the start point for cutting operations with the full-cutting mechanism 300 of the cutting mechanism 80. Thus, in S120 the CPU 21 executes a fixed-quantity forward process. Subsequently, the CPU 21 ends the forward process and returns to the full-cutting process of FIG. 12.

Figure 23:
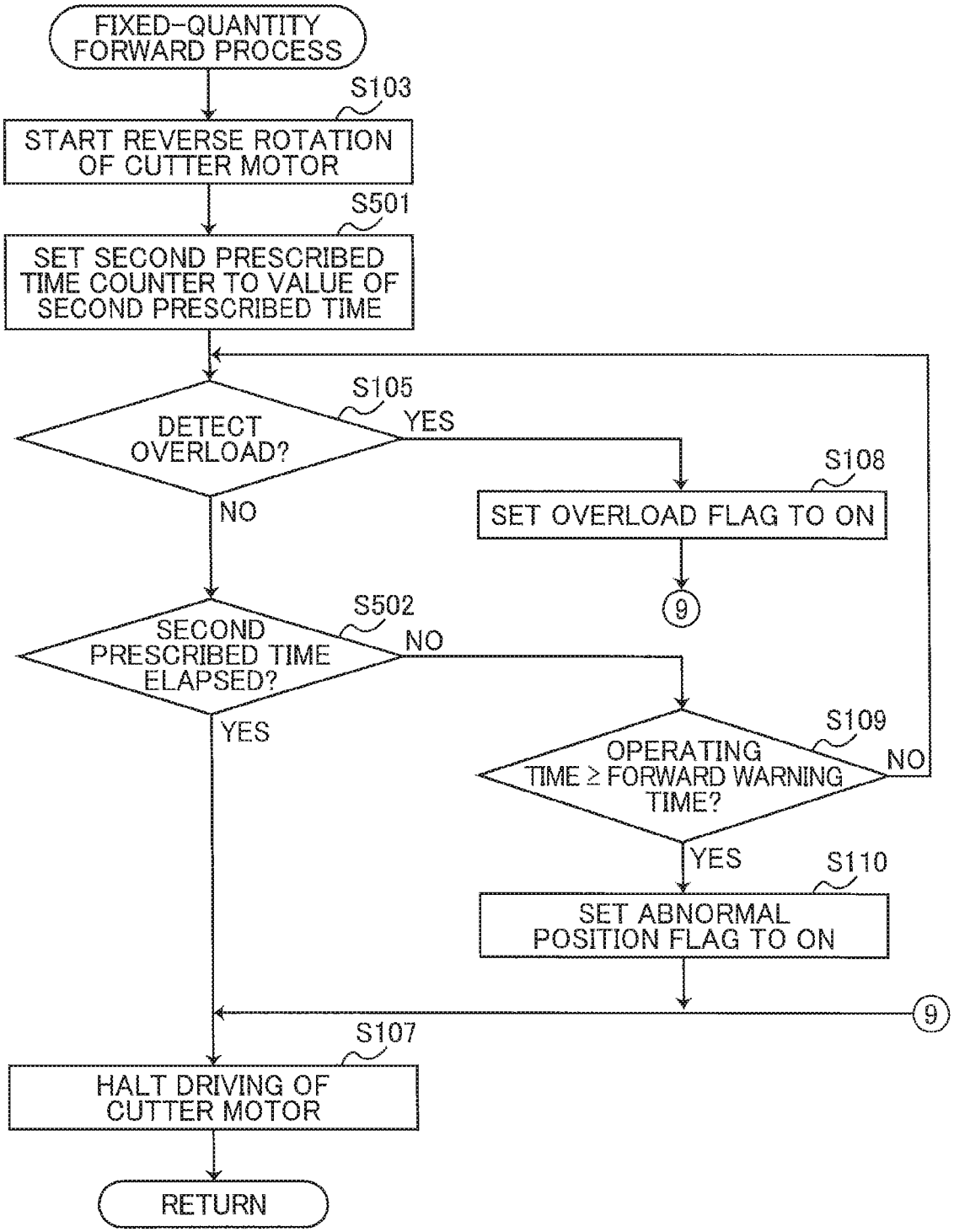
FIG. 23 is a flowchart illustrating a fixed-quantity forward process in the forward process executed by the CPU 21 in the printing device 1 according to the embodiment.

Next, the fixed-quantity forward process will be described with reference to FIG. 23. Since the fixed-quantity forward process shares common steps with the forward process performed when the first sensor 91 is operating normally, common steps in this process are designated with the same step numbers and a description of these steps will be simplified. In S103 of FIG. 23, the CPU 21 controls the cutter motor 90 to make reverse rotation. In S501 the CPU 21 sets the second prescribed time counter which is a down counter to the value of the second prescribed time to begin counting down the second prescribed time.

In S105 the CPU 21 determines whether an overload on the cutter motor 90 has been detected. When the CPU 21 determines that an overload has been detected (S105: YES), in S108 the CPU 21 sets the overload flag to ON and advances to S107.

However, when an overload has not been detected (S105: NO), in S502 the CPU 21 determines whether the second prescribed time has elapsed based on the value of the second prescribed time counter. When the second prescribed time counter is not "0", indicating that the second prescribed time has not elapsed (S502: NO), in S109 the CPU 21 determines whether the operating time has reached the forward warning time. When the CPU 21 determines that the operating time has not reached the forward warning time (S109: NO), the CPU 21 returns to S105. On the other hand, when the CPU 21 determines that the operating time has reached the forward warning time (S109: YES), in S110 the CPU 21 sets the abnormal position flag to ON, and subsequently advances to S107.

On the other hand, when the value of the second prescribed time counter is "0", indicating that the second prescribed time has elapsed (S502: YES), in S107 the CPU 21 halts driving of the cutter motor 90. Subsequently, the CPU 21 ends the fixed-quantity forward process and returns to the forward process.

Figure 12:
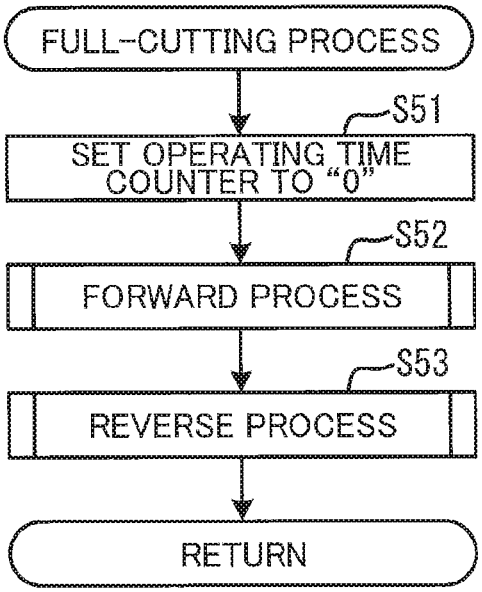
FIG. 12 is a flowchart illustrating a full-cutting process in the main process executed by the CPU 21 in the printing device 1 according to the embodiment.

Returning to FIG. 13, when either the fixed-quantity flag or the first fixed-quantity flag is not ON after beginning the forward process in the full-cutting process of FIG. 12 (S101: NO), in S102 the CPU 21 determines whether the calculation flag and the first calculation flag are both ON. If both flags are ON (S102: YES), then the first calculation updating process has been executed in the position updating process and the second updated cutting position is to be used in place of the second cutting position as the start point for cutting operations with the full-cutting mechanism 300 of the cutting mechanism 80. Thus, in S130 the CPU 21 executes a calculation forward process, and subsequently ends the forward process and returns to the full-cutting process.

Figure 24:
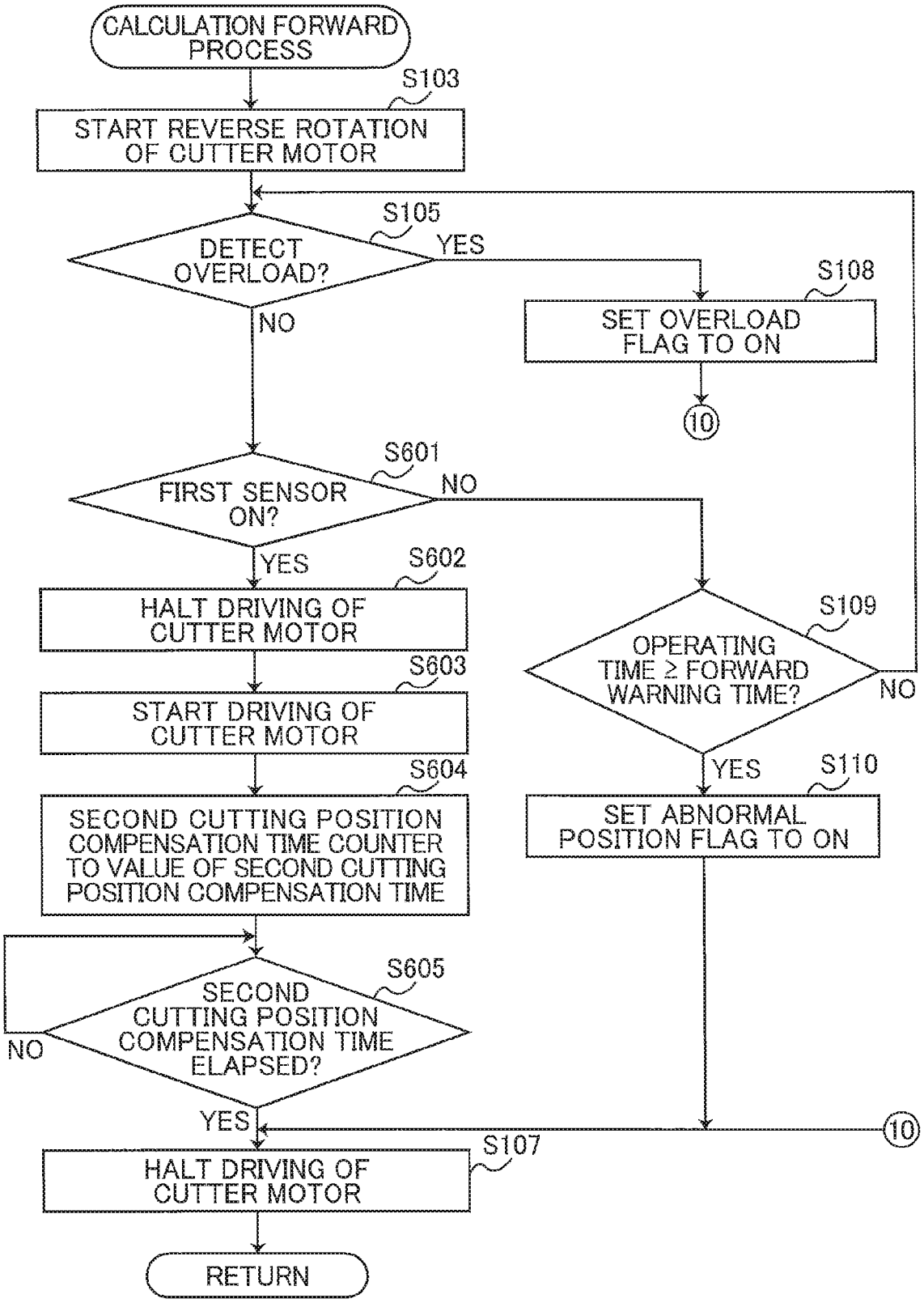
FIG. 24 is a flowchart illustrating a calculation forward process in the forward process executed by the CPU 21 in the printing device 1 according to the embodiment.

The calculation forward process will be described with reference to FIG. 24. Since some steps in the calculation forward process are shared with the forward process when the first sensor 91 is operating normally, these shared steps are designated with the same step numbers and a description of these steps will be simplified. In S103 of FIG. 24, the CPU 21 controls the cutter motor 90 to start reverse rotation. In S105 the CPU 21 determines whether an overload on the cutter motor 90 has been detected. When an overload has been detected (S105: YES), in S108 the CPU 21 sets the overload flag to ON, and subsequently advances to S107.

On the other hand, when an overload has not been detected (S105: NO), in S601 the CPU 21 determines whether the first sensor 91 is ON. In the calculation forward process, the position detected by the first sensor 91 differs from the second cutting position. When the first sensor 91 is OFF (S601: NO), in S109 the CPU 21 determines whether the operating time has reached the forward warning time. When the CPU 21 determines that the operating time has not reached the forward warning time (S109: NO), the CPU 21 returns to S105. When the CPU 21 determines that the operating time has reached the forward warning time (S109: YES), in S110 the CPU 21 sets the abnormal position flag to ON, and subsequently advances to S107.

On the other hand, when the first sensor 91 is ON (S601: YES), in S602 the CPU 21 halts driving of the cutter motor 90, and subsequently in S603 begins driving the cutter motor 90 again. The direction that the cutter motor 90 is rotated in S603 is the rotational direction that was stored in S431 of the first calculation updating process (see FIG. 20). In S604 the CPU 21 sets a second cutting position compensation time counter to a value of the second cutting position compensation time stored in the flash memory 22 to begin counting down the second cutting position compensation time. The second cutting position compensation time counter is a down counter.

In S605 the CPU 21 determines whether the second cutting position compensation time has elapsed based on the value of the second cutting position compensation time counter. When the CPU 21 determines that the value of the second cutting position compensation time counter is not "0", indicating that the second cutting position compensation time has not elapsed (S605: NO), the CPU 21 continues to repeat the determination in S605. When the value for the second cutting position compensation time counter is "0", indicating that the second cutting position compensation time has elapsed (S605: YES), in S107 the CPU 21 halts driving of the cutter motor 90. Subsequently, the CPU 21 ends the calculation forward process and returns to the forward process.

Note that the second cutting position compensation time in this process and the second detection time counted in the first calculation updating process of FIG. 20 are both the time required for the movable portion 320 to move between the position that the first sensor 91 switches from OFF to ON and the second updated cutting position (or the second cutting position) beginning from when the cutter motor 90 is in a halted state. Hence, the second cutting position compensation time is the same value as the second detection time.

In S53 of the full-cutting process in FIG. 12, the CPU 21 begins the reverse process illustrated in FIG. 14. When the abnormal position flag and the overload flag are both OFF (S151: NO, S152: NO) and the fixed-quantity flag is ON but the first fixed-quantity flag is OFF (S153: YES), then the second fixed-quantity updating process has been executed in the position updating process and the second updated standby position is to be used in place of the second standby position as the start point for cutting operations with the full-cutting mechanism 300 of the cutting mechanism 80. Accordingly, in S170 the CPU 21 executes a fixed-quantity reverse process, and subsequently ends the reverse process and returns to the full-cutting process.

Figure 25:
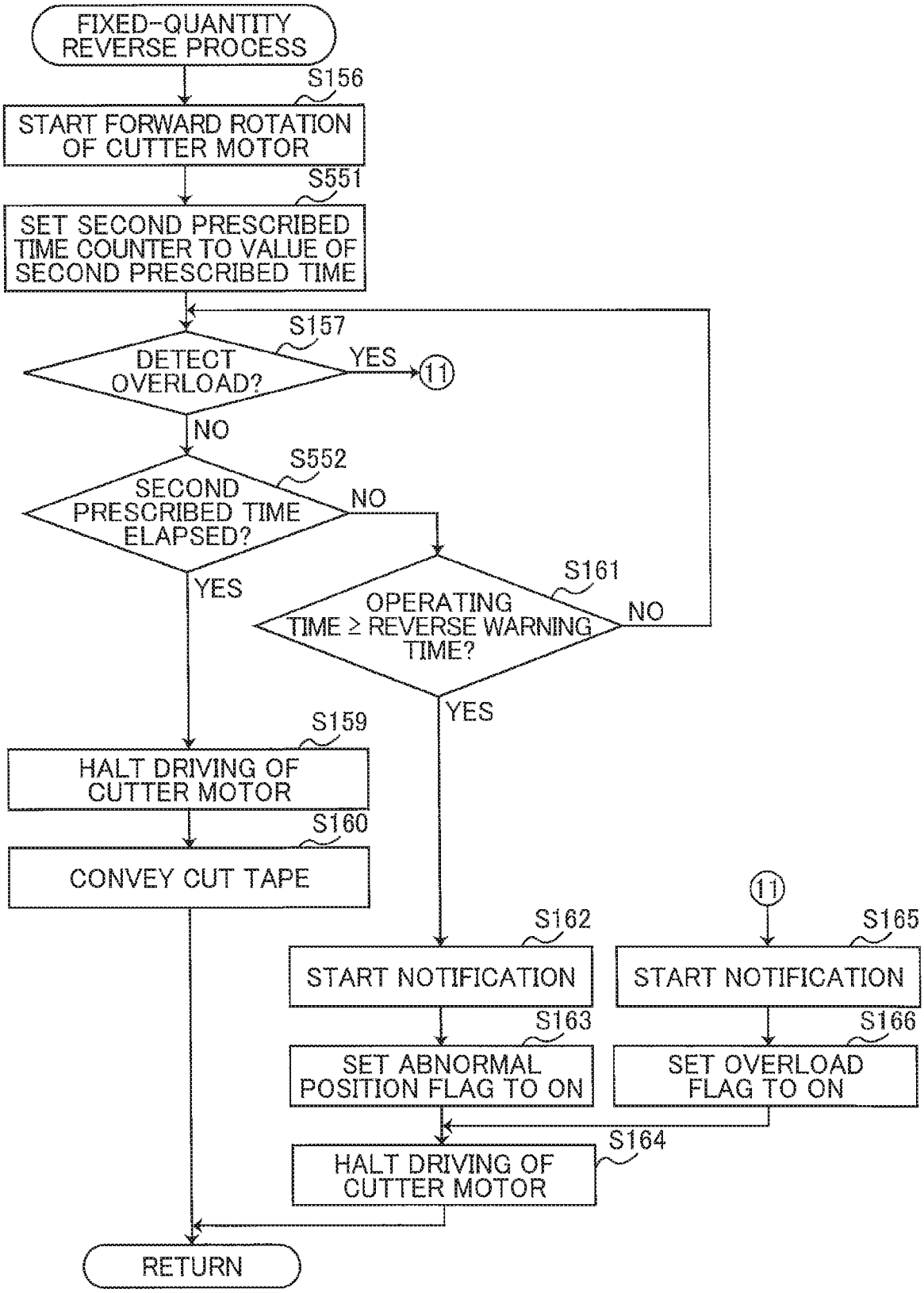
FIG. 25 is a flowchart illustrating a fixed-quantity reverse process in the reverse process executed by the CPU 21 in the printing device 1 according to the embodiment.

Here, the fixed-quantity reverse process will be described with reference to FIG. 25. Since some steps in the fixed-quantity reverse process are shared with the reverse process when the second sensor 92 is operating normally, common steps will be designated with the same step numbers and a description of these steps will be simplified. In S156 of FIG. 25, the CPU 21 controls the cutter motor 90 to make forward rotation. In S551 the CPU 21 sets the second prescribed time counter, which is a down counter, to the value of the second prescribed time and begins counting down the second prescribed time.

In S157 the CPU 21 determines whether an overload on the cutter motor 90 has been detected. When an overload has been detected (S157: YES), in S165 the CPU 21 issues a notification by lighting the LED 4, in S166 sets the overload flag to ON, and advances to S164.

On the other hand, when an overload on the cutter motor 90 has not been detected (S157: NO), in S552 the CPU 21 determines whether the second prescribed time has elapsed based on the value of the second prescribed time counter. When the value for the second prescribed time counter is not "0", indicating that the second prescribed time has not elapsed (S552: NO), in S161 the CPU 21 determines whether the operating time has reached the reverse warning time. When the CPU 21 determines that the operating time has not reached the reverse warning time (S161: NO), the CPU 21 returns to S157.

When the CPU 21 determines that the operating time has reached the reverse warning time (S161: YES), in S162 the CPU 21 issues a notification by lighting the LED 4, and in S163 sets the abnormal position flag to ON. In S164 the CPU 21 halts driving of the cutter motor 90, and subsequently ends the fixed-quantity reverse process and returns to the reverse process.

On the other hand, when the value of the second prescribed time counter is "0", indicating that the second prescribed time has elapsed (S552: YES), in S159 the CPU 21 halts driving of the cutter motor 90, and in S160 controls the conveying mechanism 400 to discharge the printed tape 57 through the discharge opening 111. Subsequently, the CPU 21 ends the fixed-quantity reverse process and returns to the reverse process.

When beginning the reverse process illustrated in FIG. 14 in the full-cutting process of FIG. 12, when both the abnormal position flag and the overload flag are OFF (S151: NO, S152: NO) and the fixed-quantity flag is ON but the first fixed-quantity flag is not OFF (S153: NO), in S154 the CPU 21 determines whether the calculation flag is ON and the first calculation flag is OFF.

When the CPU 21 determines that the calculation flag is ON and the first calculation flag is OFF (S154: YES), then the second calculation updating process has been executed in the position updating process and the second updated standby position is to be used in place of the second standby position as the start point for cutting operations with the cutting mechanism 80. Accordingly, in S180 the CPU 21 executes a calculation reverse process, and subsequently ends the reverse process and returns to the full-cutting process.

Figure 26:
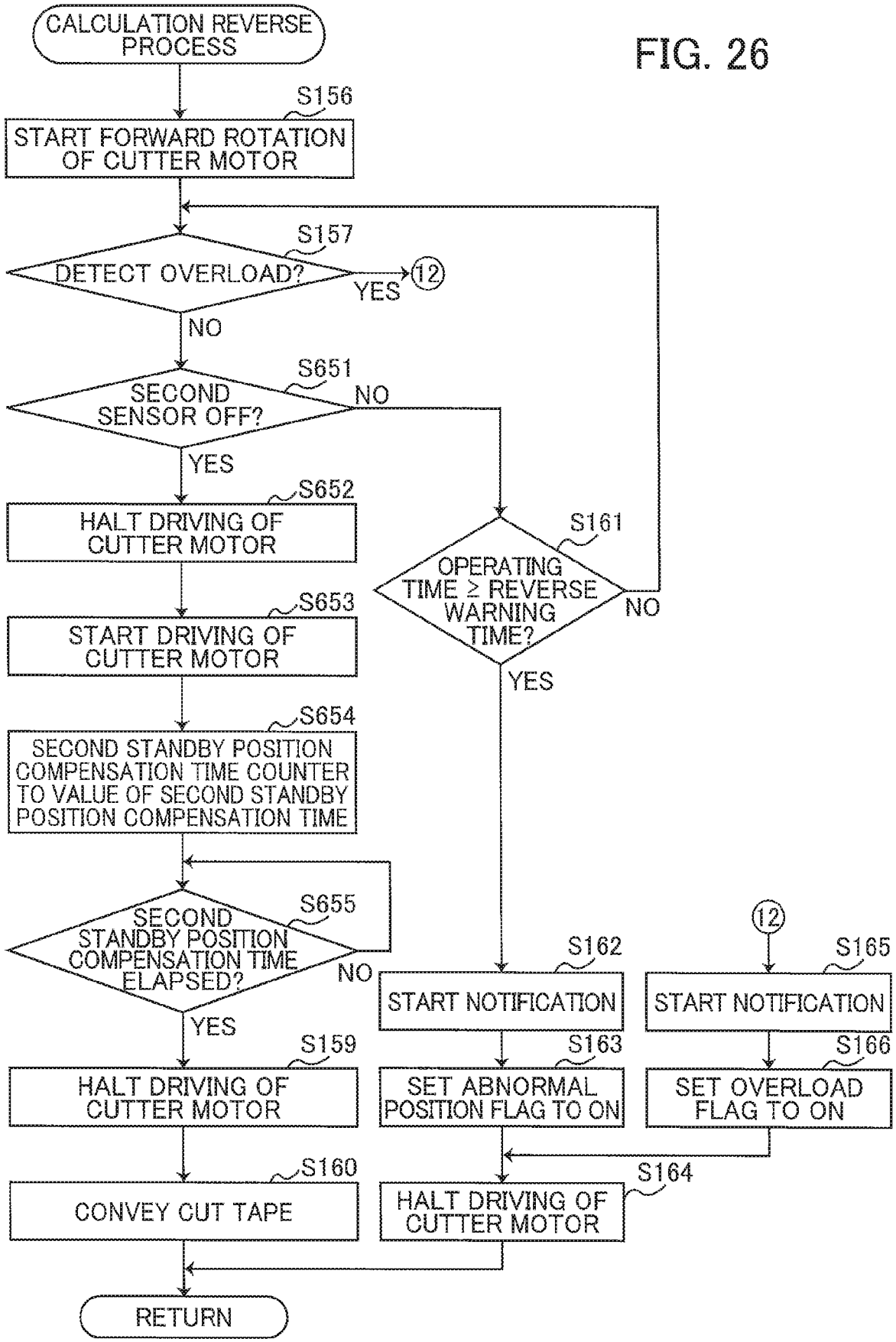
FIG. 26 is a flowchart illustrating a calculation reverse process in the reverse process executed by the CPU 21 in the printing device 1 according to the embodiment.

Here, the calculation reverse process will be described with reference to FIG. 26. Since some steps in the calculation reverse process are shared with the reverse process when the second sensor 92 is operating normally, common steps will be designated with the same step numbers and a description of the steps will be simplified. In S156 of FIG. 26, the CPU 21 controls the cutter motor 90 to start forward rotation. In S157 the CPU 21 determines whether an overload on the cutter motor 90 has not been detected. If an overload has been detected (S157: YES), in S165 the CPU 21 issues a notification by lighting the LED 4, in S166 sets the overload flag to ON, and advances to S164.

When an overload on the cutter motor 90 has not been detected (S157: NO), in S651 the CPU 21 determines whether the second sensor 92 is OFF. In the calculation reverse process, the position detected by the first sensor 91 differs from the second standby position. Hence, when the second sensor 92 is ON (S651: NO), in S161 the CPU 21 determines whether the operating time has reached the reverse warning time. If the operating time has not reached the reverse warning time (S161: NO), the CPU 21 returns to S157.

When the operating time has reached the reverse warning time (S161: YES), in S162 the CPU 21 issues a notification by lighting the LED 4, in S163 sets the abnormal position flag to ON, and advances to S164. In S164 the CPU 21 halts driving of the cutter motor 90. Subsequently, the CPU 21 ends the calculation reverse process and returns to the reverse process.

On the other hand, when the second sensor 92 is OFF (S651: YES), in S652 the CPU 21 halts driving of the cutter motor 90 and subsequently in S653 begins driving the cutter motor 90 again. The direction in which the cutter motor 90 is rotated in S653 is the rotational direction that has been stored in S478 of the second calculation updating process (see FIG. 22). In S654 the CPU 21 sets a second standby position compensation time counter to the value of the second standby position compensation time stored in the flash memory 22 and begins counting down the second standby position compensation time. The second standby position compensation time counter is a down counter.

In S655 the CPU 21 determines whether the second standby position compensation time has elapsed based on the value of the second standby position compensation time counter. When the value of the second standby position compensation time counter is not "0", indicating that the second standby position compensation time has not elapsed (S655: NO), the CPU 21 continues to repeat the determination in S655. However, when the value of the second standby position compensation time counter is "0", indicating that the second standby compensation time has elapsed (S605: YES), in S159 the CPU 21 halts driving of the cutter motor 90 and in S160 controls the conveying mechanism 400 to discharge the printed tape 57 through the discharge opening 111. Subsequently, the CPU 21 ends the calculation reverse process and returns to the reverse process.

Effects of the Embodiment

As described above, the cutting mechanism 80 of the printing device 1 is provided with the half-cutting mechanism 200. The movable portion 220 of the half-cutting mechanism 200 is reciprocally movable between the first cutting position and the first standby position. By moving forward from the first standby position toward the first cutting position for the first prescribed time, the movable portion 220 cuts through a portion of the printed tape 57. The cutting mechanism 80 is also provided with the full-cutting mechanism 300. The movable portion 320 of the full-cutting mechanism 300 is reciprocally movable between the second cutting position and the second standby position. By moving forward from the second standby position toward the second cutting position for the second prescribed time, the movable portion 320 cuts the printed tape 57.

The cutting mechanism 80 is further provided with the first sensor 91 for detecting when the movable portion 220 is in the first cutting position and when the movable portion 320 is in the second cutting position, and the second sensor 92 for detecting when the movable portion 220 is in the first standby position and when the movable portion 320 is in the second standby position.

When the first sensor 91 does not operate normally (i.e., does not perform detection accurately), the CPU 21 executes the first fixed-quantity updating process. In this process, the CPU 21 sets the position of the movable portion 220 moved forward from the first standby position by the cutter motor 90 for the first prescribed time as a first updated cutting position, and stores this first updated cutting position in the flash memory 22. In this way, the first updated cutting position serves as a new start point for reciprocating the movable portion 220 in place of the first cutting position. Additionally, the CPU 21 sets the position of the movable portion 320 moved forward from the second standby position by the cutter motor 90 for the second prescribed time as a second updated cutting position, and stores this second updated cutting position in the flash memory 22. Accordingly, the second updated cutting position serves as a new start point for reciprocating the movable portion 320 in place of the second cutting position.

Thus, even when the first sensor 91 is operating abnormally, the printing device 1 can set a first updated cutting position and a second updated cutting position as new start points for reciprocation based on the first standby position and the second standby position detected by the second sensor 92. Accordingly, the printing device 1 can reliably cut through at least a portion of the object (i.e., the tape 57) using only the second sensor 92 when the first sensor 91 is abnormal.

Further, when the second sensor 92 does not operate normally (i.e., does not perform detection accurately), the CPU 21 executes the second fixed-quantity updating process. In this process, the CPU 21 sets the position of the movable portion 220 moved from the first cutting position by the cutter motor 90 for the first prescribed time as a first updated standby position. The first updated standby position is stored in the flash memory 22, and serves as the new start point for reciprocating the movable portion 220 in place of the first standby position. Also, the CPU 21 sets the position of the movable portion 320 moved by the cutter motor 90 for the second prescribed time from the second cutting position as a second updated standby position, and stores the second updated standby position in the flash memory 22. Therefore, the second updated standby position serves as the new start point for reciprocating the movable portion 320 in place of the second standby position.

Thus, even when the second sensor 92 is operating abnormally, the printing device 1 can set a first updated standby position and a second updated standby position as new start points for reciprocation based on the first cutting position and the second cutting position detected by the first sensor 91. Accordingly, the printing device 1 can reliably cut at least a portion of the object (i.e., the tape 57) using only the first sensor 91, when the second sensor 92 is abnormal.

When the detected position of one of the first sensor 91 and the second sensor 92 is an abnormal position that differs from the detected position of the first sensor 91 or the second sensor 92 when these sensors perform detections accurately, the CPU 21 executes the corresponding first calculation updating process or second calculation updating process. In the first and second calculation updating processes, the CPU 21 calculates an offset direction and a compensation time between the detected position of the remaining one sensor that performs detection accurately and the abnormal position.

When executing the first calculation updating process, the CPU 21 sets a first updated cutting position to be used as a new start point for reciprocation of the movable portion 220 in place of the first cutting position and sets a second updated cutting position to be used as a new start point for reciprocation of the movable portion 320 in place of the second cutting position based on the calculated offset directions and compensation times, and stores the first updated cutting position and the second updated cutting position in the flash memory 22.

When executing the second calculation updating process, the CPU 21 sets a first updated standby position to be used as a new start point for reciprocating the movable portion 220 in place of the first standby position and sets a second updated standby position to be used as a new start point for reciprocating the movable portion 320 in place of the second standby position based on the calculated offset directions and compensation times, and stores the first updated standby position and the second updated standby position in the flash memory 22.

Accordingly, even when one of the first sensor 91 and the second sensor 92 performs detections in an abnormal position, the printing device 1 can set a first updated cutting position and a second updated cutting position or a first updated standby position and a second updated standby position as new references for reciprocation based on detections by the remaining one sensor that operates normally. Therefore, the printing device 1 can perform cutting operations normally using the cutting mechanism 80 even when one of the first sensor 91 and the second sensor 92 performs detection in its abnormal position.

The CPU 21 uses the first prescribed time and the second prescribed time to control the time for driving the cutter motor 90. In this way, the printing device 1 can control the movement amounts of the movable portion 220 and the movable portion 320.

The cutting mechanism 80 is provided with the drive cam 76 that is rotatable in association with the cutter motor 90. The drive cam 76 moves the movable portion 220 forward when the cutter motor 90 makes forward rotation, and moves the movable portion 320 forward when the cutter motor 90 makes reverse rotation. The first sensor 91 can detect when the movable portion 220 is in the first cutting position by detecting when the drive cam 76 is in a preset first angular position. The first sensor 91 can detect when the movable portion 320 is in the second cutting position by detecting when the drive cam 76 is in a preset second angular position.

The second sensor 92 can detect when the movable portion 220 is in the first standby position and the movable portion 320 is in the second standby position by detecting when the drive cam 76 is in a preset reference angular position. In this way, the first sensor 91 and the second sensor 92 can detect the position of the movable portion 220 or the movable portion 320 by detecting the angular position of the drive cam 76.

Variations of the Embodiment

While the description has been made in detail with reference to the embodiment, it would be apparent to those skilled in the art that many modifications and variations may be made thereto.

While new start points for reciprocation of the movable portion 220 and the movable portion 320 are set in the position updating process in the above-described embodiment, the target of settings is not limited to these start points. For example, a third standby position or a conveying position which is the start point for reciprocation of the conveying mechanism 400 may be set in place of the start point for reciprocation of the movable portion 320.

In the above-described embodiment, movement amounts for reciprocating the movable portion 220 and the movable portion 320 are controlled by time periods for driving the cutter motor 90, such as the first prescribed time, but the movement amounts may be controlled by rotational amounts of the cutter motor 90 instead. In this case, the CPU 21 can control the movable portion 220 and the movable portion 320 without considering acceleration and deceleration of the rotating cutter motor 90.

When executing the first calculation updating process and the second calculation updating process in the above-described embodiment, the CPU 21 calculates offset automatically without requiring the user to perform operations. However, the offset may be calculated based on user's operations. For example, in the first and second calculation updating processes, the cutter motor 90 is rotated a prescribed number of rotations when the user operates the switches 3. The movable portion 220 or the movable portion 320 is moved in accordance with the number of times that the user operates the switches 3. When the first sensor 91 or the second sensor 92 performs detection, the CPU 21 issues a notification with the LED 4. The user then instructs the end of the operations to the CPU 21 via the switches 3. Accordingly, the CPU 21 can calculate offset based on the number of times that the user operated the switches 3.

The cutting mechanism 80 may also perform so-called overrun correction in order to decelerate the rotational speed of the cutter motor 90 prior to the movable portion 220 or the movable portion 320 arriving at the start point for reciprocation. In this case, overrun of the movable portion 220 and the movable portion 320 can be suppressed, enabling the movable portion 220 or the movable portion 320 to be halted precisely at the start point.

The printing device 1 may also have a non-cutting mode that can be selected in order to suspend cutting operations, such as the half-cutting process of S10 or the full-cutting process of S12, performed by the cutting mechanism 80 in the main process (see FIG. 11). Further, the printing device 1 may pause execution of the start point determination in the initialization process of the main process for setting the positions of the movable portion 220 and the movable portion 320 to the corresponding first standby position and second standby position. In this case, the printing device 1 can continue to execute only printing operations on the tape, despite abnormalities with the cutting mechanism 80.

While the first sensor 91 and the second sensor 92 are mechanical sensors in the above-described embodiment, the first sensor 91 and the second sensor 92 may also be optical sensors or magnetic sensors. Further, while the movable portion 220 and the movable portion 320 are pivotally movable about the corresponding rotational shaft 201 and the rotational shaft 301 in the above-described embodiment, the movable portion 220 and the movable portion 320 may be supported by rails or other guide members so as to be capable of moving linearly in the directions toward and away from the corresponding fixed portions 210 and 310.

REMARKS

The printing device 1 is an example of a cutting device and a printing device. The cutting blade 223 and the movable blade 324 are examples of a movable blade. The cutting blade 223 is also an example of a first movable blade. The movable blade 324 is also an example of a second movable blade. The tape 57 is an example of an object. The half-cutting mechanism 200 and the full-cutting mechanism 300 are an example of a moving mechanism. The movable portion 220 is an example of a first mechanism portion. The first cutting position is an example of a first operating position. The first standby position is an example of a first non-operating position. The movable portion 320 is an example of a second mechanism portion. The second cutting position is an example of a second operating position. The second standby position is an example of a second non-operating position. The first updated cutting position is an example of a first updated operating position. The first updated standby position is an example of a first updated non-operating position. The second updated cutting position is an example of a second updated operating position. The second updated standby position is an example of a second updated non-operating position. The combination of the cutter motor 90 and the cam plate 760 is an example of a driver. The first sensor 91 is an example of a first detecting portion. The cutter motor 90 is an example of a motor. The cam plate 760 is an example of a rotating member. The second sensor 92 is an example of a second detecting portion. The flash memory 22 is an example of a storage medium. The CPU 21 is an example of a controller. The first prescribed time is an example of a first prescribed amount. The second prescribed time is an example of a second prescribed amount. The first angular position is an example of a first angular position. The second angular position is an example of a second angular position. The reference angular position is examples of a third angular position and a second angular position. The thermal head 10 is an example of a printing mechanism. The process in S301, S302, S351, S352, S413, S414, S431, S432, S463, S464, S478 and S479 executed by the CPU 21 is an example of (a) setting. The process in S301, S302, S351, S352, S414, S432, S464 and S479 executed by the CPU 21 is an example of (b) storing. The process in S301 executed by the CPU 21 is an example of (a1) setting. The process in S302 executed by the CPU 21 is an example of (a2) setting. The process in S351 executed by the CPU 21 is an example of (a3) setting. The process in S352 executed by the CPU 21 is an example of (a4) setting. The process in S413, S431, S463 and S478 executed by the CPU 21 is an example of (a5) calculating. The process in S414, S432, S464 and S479 executed by the CPU 21 is an example of (a6) setting.

What is claimed is:

1. A cutting device comprising:

a movable blade configured to cut at least a portion of an object;

a moving mechanism configured to move the movable blade, the moving mechanism comprising:

a first mechanism portion reciprocally movable between a first operating position and a first non-operating position; and a second mechanism portion reciprocally movable between a second operating position and a second non-operating position;

a driver configured to be driven to move the moving mechanism;

a first detecting portion for performing detection of the first operating position of the first mechanism portion and the second operating position of the second mechanism portion;

a second detecting portion for performing detection of the first non-operating position of the first mechanism portion and the second non-operating position of the second mechanism portion;

a storage medium; and a controller configured to perform processing including:

detecting first data indicative of whether the first detecting portion is operating normally or abnormally;

detecting second data indicative of whether the second detecting portion is operating normally or abnormally;

(a) setting, when one of (i) the first detecting portion is operating abnormally and (ii) the second detecting portion is operating abnormally, an updated position of each of one of (i) the first operating position and the second operating position and (ii) the first non-operating position and the second non-operating position, the updated position being set based on a detection result of the remaining one of the first detecting portion and the second detecting portion that is operating normally and the updated position being a new start point of reciprocating movement of the first mechanism portion and the second mechanism portion in place of the each of the one of (i) the first operating position and the second operating position and (ii) the first non-operating position and the second non-operating position; and (b) storing the updated position set in the (a) setting in the storage medium.

2. The cutting device according to claim 1, wherein the movable blade comprises a first movable blade and a second movable blade, wherein the first mechanism portion comprises the first movable blade, the first movable blade being configured to be moved forward from the first non-operating position of the first mechanism portion toward the first operating position of the first mechanism portion a first prescribed amount to cut at least a portion of the object, and wherein the second mechanism portion comprises the second movable blade, the second movable blade being configured to move forward from the second non-operating position of the second mechanism portion toward the second operating position of the second mechanism portion a second prescribed amount to cut at least a portion of the object.

3. The cutting device according to claim 2, wherein, in the (a) setting, the controller is configured to perform:

when the first detecting portion is operating abnormally, (a1) setting a position of the first movable blade moved forward from the first non-operating position the first prescribed amount by the driver as a first updated operating position, the first updated operating position being the updated position of the first mechanism portion used in place of the first operating position; and (a2) setting a position of the second movable blade moved forward from the second non-operating position the second prescribed amount by the driver as a second updated operating position, the second updated operating position being the updated position of the second mechanism portion used in place of the second operating position.

4. The cutting device according to claim 2, wherein, in the (a) setting, the controller is configured to perform:

when the second detecting portion is operating abnormally, (a3) setting a position of the first movable blade moved reverse from the first operating position the first prescribed amount as a first updated non-operating position, the first updated non-operating position being the updated position of the first mechanism portion used in place of the first non-operating position; and (a4) setting a position of the second movable blade moved reverse from the second operating position the second prescribed amount as a second updated non-operating position, the second updated non-operating position being the updated position of the second mechanism portion used in place of the second non-operating position.

5. The cutting device according to claim 2, wherein the driver comprises a motor rotatable in a forward direction and a reverse direction to move the first mechanism portion and the second mechanism portion, and wherein, in the (a) setting, the controller uses the first prescribed amount and the second prescribed amount to control a rotation amount or the number of rotations of the motor.

6. The cutting device according to claim 5, wherein the driver further comprises a rotating member rotatable in association with rotation of the motor, the rotating member being configured to move the first mechanism portion forward in accordance with the rotation of the motor in the forward direction, the rotating member being configured to move the second mechanism portion forward in accordance with the rotation of the motor in the reverse direction, wherein the first detecting portion is configured to perform detection of the first operating position of the first mechanism portion by detecting that the rotating member is in a preset first angular position and the second operating position of the second mechanism portion by detecting that the rotating member is in a preset second angular position, and wherein the second detecting portion is configured to perform detection of the first non-operating position of the first mechanism portion by detecting that the rotating member is in a preset third angular position and the second non-operating position of the second mechanism portion by detecting that the rotating member is in a preset fourth angular position.

7. The cutting device according to claim 1, wherein, in the (a) setting, the controller is configured to perform:

when one of the first detecting portion and the second detecting portion performs detection in an abnormal position, (a5) calculating an offset amount and an offset direction between a normal position detected by the remaining one of the first detecting portion and the second detecting portion that is operating normally the abnormal position; and (a6) setting the updated position based on the offset position and the offset direction calculated in the (a5) calculating.

8. The cutting device of claim 1, wherein:

the first data includes a first flag, and the second data includes a second flag.

9. The cutting device of claim 8, wherein:

the first flag includes a first value, of the first flag, to indicate that the first detecting portion is operating normally and a second value, of the first flag, to indicate that the first detecting portion is operating abnormally; and the second flag includes a first value, of the second flag, to indicate that the second detecting portion is operating normally and a second value, of the second flag, to indicate that the second detecting portion is operating abnormally.

10. The cutting device of claim 1, wherein in response to at least one of a first condition and a second condition being met, the controller determines that the first detecting portion is operating abnormally, the first condition being met when the first detecting portion does not detect the first mechanism portion even though the controller has performed a process of moving the first mechanism portion to the first operating position, the second condition being met when the first detecting portion does not detect the second mechanism portion even though the controller has performed a process of moving the second mechanism portion to the second operating position, and wherein in response to at least one of a third condition and a fourth condition being met, the controller determines that the second detecting portion is operating abnormally, the third condition being met when the second detecting portion does not detect the first mechanism portion even though the controller has performed a process of moving the first mechanism portion to the first non-operating position, the fourth condition being met when the second detecting portion does not detect the second mechanism portion even though the controller has performed a process of moving the second mechanism portion to the second non-operating position.

11. A printing device comprising:

a cutting device comprising:

a movable blade configured to cut at least a portion of an object;

a moving mechanism configured to move the movable blade, the moving mechanism comprising:

a first mechanism portion reciprocally movable between a first operating position and a first non-operating position; and a second mechanism portion reciprocally movable between a second operating position and a second non-operating position;

a driver configured to be driven to move the moving mechanism;

a first detecting portion for performing detection of the first operating position of the first mechanism portion and the second operating position of the second mechanism portion;

a second detecting portion for performing detection of the first non-operating position of the first mechanism portion and the second non-operating position of the second mechanism portion;

a storage medium; and a controller configured to perform processing including:

detecting first data indicative of whether the first detecting portion is operating normally or abnormally;

detecting second data indicative of whether the second detecting portion is operating normally or abnormally;

(a) setting, when one of (i) the first detecting portion is operating abnormally and (ii) the second detecting portion is operating abnormally, an updated position of each of one of (i) the first operating position and the second operating position and (ii) the first non-operating position and the second non-operating position, the updated position being set based on a detection result of the remaining one of the first detecting portion and the second detecting portion that is operating normally the updated position being a new start point of reciprocating movement of the first mechanism portion and the second mechanism portion in place of the each of the one of (i) the first operating position and the second operating position and (ii) the first non-operating position and the second non-operating position; and (b) storing the updated position set in the (a) setting in the storage medium; and a printing mechanism configured to perform printing on the object.

* * * * *